US010851944B2

(12) United States Patent
Poorman et al.

(10) Patent No.: US 10,851,944 B2
(45) Date of Patent: Dec. 1, 2020

(54) CNG FUELING SYSTEM

(71) Applicant: J-W Power Company, Addison, TX (US)

(72) Inventors: Richard Allan Poorman, Diana, TX (US); Bradley Wade Fontenot, Longview, TX (US)

( * ) Notice: Subject to any disclaimer, the term of this patent is extended or adjusted under 35 U.S.C. 154(b) by 187 days.

(21) Appl. No.: 16/032,061

(22) Filed: Jul. 10, 2018

(65) Prior Publication Data

US 2018/0320823 A1 Nov. 8, 2018

Related U.S. Application Data

(63) Continuation-in-part of application No. 15/709,084, filed on Sep. 19, 2017, now Pat. No. 10,018,304,
(Continued)

(51) Int. Cl.
*F17C 5/06* (2006.01)
*F17C 13/02* (2006.01)
(Continued)

(52) U.S. Cl.
CPC ..... *F17C 5/06* (2013.01); *F17C 5/007* (2013.01); *F17C 13/025* (2013.01); *F17C 13/04* (2013.01);
(Continued)

(58) Field of Classification Search
CPC ..... F17C 5/06; F17C 2270/0168; F17C 2260/02; F17C 2205/0338; F17C 2221/033; F17C 2227/0327
See application file for complete search history.

(56) References Cited

U.S. PATENT DOCUMENTS 2,478,321 A 8/1949 Robbins
3,719,196 A 3/1973 McJones
(Continued)

FOREIGN PATENT DOCUMENTS

CN 100346103 C 10/2007
CN 100575770 C 12/2009
(Continued)

OTHER PUBLICATIONS

BRC Fuel Maker, "The full line for CNG refueling solutions", TA01Z0171-3, Jun. 2010, 16 pages, MTM P&P Dept.
(Continued)

*Primary Examiner* — Timothy P. Kelly
(74) *Attorney, Agent, or Firm* — Lightfoot & Alford PLLC

(57) ABSTRACT

A compressed natural gas (CNG) fueling system has a single compressor comprising a first compression stage and a subsequent compression stage, wherein the first compression stage feeds the subsequent compression stage when filling a storage tank, the storage tank is configured to receive CNG from at least one of the first compression stage and the subsequent compression stage of the compressor when filling the storage tank, a CNG feedback to the subsequent compression stage of the compressor from the storage tank, the CNG being introduced back into the compressor at a location downstream relative to an output of the first compression stage, and a first heat exchanger associated with the CNG feedback.

4 Claims, 20 Drawing Sheets

Related U.S. Application Data which is a continuation-in-part of application No. 13/756,092, filed on Jan. 31, 2013, now Pat. No. 9,765,930.

(60) Provisional application No. 61/593,134, filed on Jan. 31, 2012.

(51) Int. Cl.
*F17C 13/04* (2006.01)
*F17C 5/00* (2006.01)

(52) U.S. Cl.
CPC ..... *F17C 2205/0332* (2013.01); *F17C 2205/0335* (2013.01); *F17C 2205/0338* (2013.01); *F17C 2221/033* (2013.01); *F17C 2223/0123* (2013.01); *F17C 2223/033* (2013.01); *F17C 2225/0123* (2013.01); *F17C 2225/036* (2013.01); *F17C 2227/0157* (2013.01); *F17C 2227/0164* (2013.01); *F17C 2250/01* (2013.01); *F17C 2250/043* (2013.01); *F17C 2250/0626* (2013.01); *F17C 2265/065* (2013.01); *F17C 2270/0139* (2013.01); *F17C 2270/0168* (2013.01)

(56) References Cited

U.S. PATENT DOCUMENTS

| | | | |
|---|---|---|---|
| 3,847,173 | A | 11/1974 | Hill |
| 4,522,159 | A | 6/1985 | Engel et al. |
| 4,527,600 | A | 7/1985 | Fisher et al. |
| 4,585,039 | A | 4/1986 | Hamilton |
| 4,646,940 | A | 3/1987 | Kramer et al. |
| 4,653,986 | A | 3/1987 | Ashton |
| 4,750,869 | A | 6/1988 | Shipman, III |
| 4,966,206 | A | 10/1990 | Baumann et al. |
| 5,073,090 | A | 12/1991 | Cassidy |
| 5,107,906 | A | 4/1992 | Swenson et al. |
| 5,259,424 | A | 11/1993 | Miller et al. |
| 5,263,826 | A | 11/1993 | Baumann et al. |
| 5,351,726 | A | 10/1994 | Diggins et al. |
| 5,361,796 | A | 11/1994 | Mutter |
| 5,370,159 | A | 12/1994 | Price |
| 5,387,089 | A | 2/1995 | Stogner et al. |
| 5,406,988 | A | 4/1995 | Hopkins |
| 5,409,046 | A | 4/1995 | Swenson et al. |
| 5,454,408 | A | 10/1995 | DiBella et al. |
| 5,474,104 | A | 12/1995 | Borland et al. |
| 5,479,966 | A | 1/1996 | Tison et al. |
| 5,488,978 | A | 2/1996 | Kountz et al. |
| 5,505,232 | A | 4/1996 | Barclay |
| 5,538,051 | A | 7/1996 | Brown et al. |
| 5,570,729 | A | 11/1996 | Mutter |
| 5,673,735 | A | 10/1997 | Crvelin et al. |
| 5,694,985 | A | 12/1997 | Diggins |
| 5,752,552 | A | 5/1998 | Kountz et al. |
| 5,771,947 | A | 6/1998 | Kountz et al. |
| 5,771,948 | A | 6/1998 | Kountz et al. |
| 5,810,058 | A | 9/1998 | Kountz et al. |
| 5,884,675 | A | 3/1999 | Krasnov |
| 5,974,369 | A | 10/1999 | Radtke et al. |
| 6,152,191 | A | 11/2000 | Chan et al. |
| 6,435,269 | B1 | 8/2002 | Hancock |
| 6,439,278 | B1 | 8/2002 | Krasnov |
| 6,619,336 | B2 | 9/2003 | Cohen et al. |
| 6,652,243 | B2 | 11/2003 | Krasnov |
| 6,722,399 | B1 | 4/2004 | Cano |
| 6,779,568 | B2 | 8/2004 | Borck |
| 6,792,981 | B1 | 9/2004 | Manning et al. |
| 6,851,657 | B2 | 2/2005 | Tawns |
| 7,059,364 | B2 | 6/2006 | Kountz et al. |
| 7,150,299 | B2 | 12/2006 | Hertzler et al. |
| 7,152,637 | B2 | 12/2006 | Hoke, Jr. |
| 7,168,464 | B2 | 1/2007 | Diggins |
| 7,415,995 | B2 | 8/2008 | Plummer et al. |
| 7,967,036 | B2 | 6/2011 | Ding et al. |
| 8,122,918 | B2 | 2/2012 | Handa |
| 8,267,670 | B2 | 9/2012 | Adler et al. |
| 8,281,820 | B2 | 10/2012 | White |
| 8,360,112 | B2 | 1/2013 | Allidieres et al. |
| 8,453,682 | B2 | 6/2013 | Bonner et al. |
| 8,613,201 | B2 | 12/2013 | Bayliff et al. |
| 8,833,088 | B2 | 9/2014 | Bayliff et al. |
| 8,839,829 | B2 | 9/2014 | Ding et al. |
| 8,899,278 | B2 | 12/2014 | Cohen et al. |
| 8,978,715 | B2 | 3/2015 | Allidieres |
| 9,074,606 | B1 * | 7/2015 | Moore ..... F04D 19/02 |
| 2001/0029979 | A1 | 10/2001 | Zheng et al. |
| 2001/0039961 | A1 | 11/2001 | Zheng et al. |
| 2003/0197142 | A1 | 10/2003 | Tawns |
| 2007/0009369 | A1 | 1/2007 | Dany |
| 2007/0051423 | A1 | 3/2007 | Handa |
| 2009/0250138 | A1 | 10/2009 | Bavarian et al. |
| 2010/0037982 | A1 | 2/2010 | Bangs et al. |
| 2010/0059138 | A1 | 3/2010 | Shi et al. |
| 2011/0155278 | A1 | 6/2011 | Ding |
| 2011/0240139 | A1 | 10/2011 | Ding et al. |
| 2013/0192701 | A1 | 8/2013 | Poorman |
| 2013/0248000 | A1 | 9/2013 | Killeen et al. |
| 2014/0130938 | A1 | 5/2014 | Luparello |
| 2014/0202585 | A1 | 7/2014 | Barker |
| 2014/0261863 | A1 | 9/2014 | Cohen et al. |
| 2014/0263420 | A1 | 9/2014 | Lambrix et al. |
| 2015/0000757 | A1 | 1/2015 | Bayliff et al. |
| 2015/0047738 | A1 | 2/2015 | Wilson et al. |
| 2015/0361970 | A1 * | 12/2015 | White ..... F04B 27/005 417/53 |

FOREIGN PATENT DOCUMENTS

| | | | |
|---|---|---|---|
| CN | 201715234 | U | 1/2011 |
| CN | 201757268 | U | 3/2011 |
| CN | 101813237 | B | 6/2014 |
| DE | 102014000639 | A1 | 7/2014 |
| JP | 2005127430 | A | 5/2005 |
| JP | 3720925 | B2 | 11/2005 |
| JP | 2006283840 | A | 10/2006 |
| JP | 4751014 | B2 | 8/2011 |
| KR | 100699937 | B1 | 3/2007 |
| RU | 2208199 | C1 | 7/2003 |
| WO | 9622915 | A1 | 9/1996 |
| WO | 2006031365 | A2 | 3/2006 |
| WO | 2009072160 | A2 | 6/2009 |
| WO | 2009072160 | A3 | 6/2009 |

OTHER PUBLICATIONS

PCT International Search Report; PCT Application No. PCT/US2013/024156; dated Jun. 18, 2013; 5 pgs.

PCT Written Opinion of the International Searching Authority; PCT/US2013/024156; dated Jun. 18, 2013; 6 pgs.

* cited by examiner

CNG FUELING SYSTEM

BACKGROUND

Some compressed natural gas (CNG) fueling systems are configured for operation with relatively high natural gas source pressures. In some cases, CNG fueling systems comprise multiple compressors, multiple compressor crankshafts, and/or multiple compressor driver devices. In some cases, CNG fueling systems comprise multiple CNG storage tanks and/or are not capable of filling a fuel tank quickly.

SUMMARY

Some compressed natural gas (CNG) fueling systems are configured for operation with relatively high natural gas source pressures. In some cases, CNG fueling systems comprise multiple compressors, multiple compressor crankshafts, and/or multiple compressor driver devices. In some cases, CNG fueling systems comprise multiple CNG storage tanks and/or are not capable of filling a fuel tank quickly. In some embodiments of the disclosure, a compressed natural gas (CNG) fueling system is disclosed as comprising a single compressor, a storage tank configured to receive CNG from the compressor, and a CNG feedback to the compressor from the storage tank.

In other embodiments of the disclosure, a method of operating a compressed natural gas (CNG) fueling system is disclosed as comprising providing a single compressor, storing CNG compressed by the compressor, and further compressing the stored CNG using the compressor.

In yet other embodiments of the disclosure, a compressed natural gas (CNG) fueling system is disclosed as comprising a single separable reciprocating gas compressor comprising a plurality of compression stages, a storage tank configured to receive CNG from the compressor, and a feedback configured to provide CNG from the storage tank to at least one of the plurality of compression stages.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION

In some cases, it may be desirable to provide a CNG refueling system capable of speedily refueling a vehicle storage tank and/or any other suitable CNG related device without multiple compressors, multiple compressor drivers, and/or a high pressure natural gas source. In some embodiments, this disclosure provides a CNG refueling system comprising one compressor, one compressor driver, and/or a low pressure natural gas source. In some embodiments, the above-described CNG refueling system may be configured to feed CNG previously compressed by the compressor back into the same compressor and to transfer the recompressed CNG to a vehicle storage tank.

Figure 1:
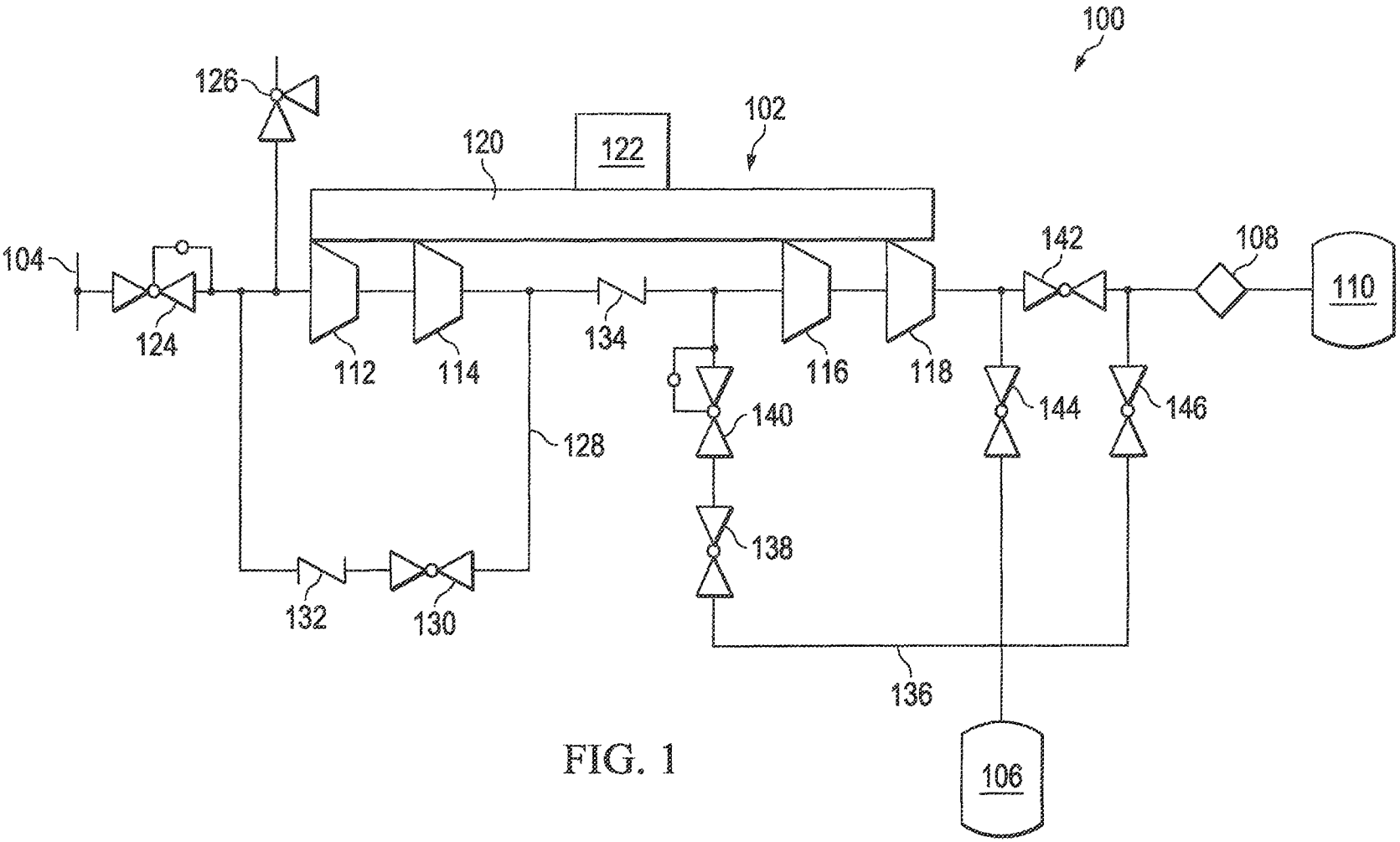
FIG. 1 is a schematic diagram of a CNG fueling system according to an embodiment of the disclosure.

Referring now to FIG. 1, a schematic of a CNG fueling system 100 is shown according to an embodiment of the disclosure. The CNG fueling system 100 may generally comprise a compressor 102, a natural gas source 104, a storage tank 106, and a CNG dispenser 108. The CNG fueling system 100 may comprise a vehicle storage tank 110 and/or the CNG fueling system 100 may be configured to selectively transfer CNG to the vehicle storage tank 110. In this embodiment, the compressor 102 comprises four stages of compression represented by a first compression stage 112, a second compression stage 114, a third compression stage 116, and a fourth compression stage 118. In this embodiment, each of the compression stages 112, 114, 116, 118 may be powered by a power transfer device 120 that may comprise a single primary crankshaft that may drive pistons of the compression stages 112, 114, 116, 118 in a reciprocating manner within associated bores of the compression stages 112, 114, 116, 118. As such, the compressor 102 may comprise a separable reciprocating gas compressor. In some cases, the power transfer device 120 may be driven by a compressor driver 122, such as, but not limited to an electrical motor, a natural gas fueled engine, a turbine, an internal combustion engine, and/or any other device suitable for providing rotational power input and/or torque power input to the power transfer device 120. In alternative embodiments, the compressor 102 may comprise more or fewer compression stages, a rotary compressor, a scroll compressor, a pneumatic and/or hydraulically powered compressor, additional power transfer devices 120, additional compressor drivers 122, and/or any other suitable means for selectively compressing natural gas.

In this embodiment, the natural gas source 104 may comprise a relatively low source pressure of less than about 350 psig, between about 5 psig to about 330 psig, between about 70 psig to about 330 psig, between about 275 psig to about 325 psig, and/or about 300 psig. A source regulator valve 124 may be configured to limit a natural gas pressure provided to the compressor 102, namely in this embodiment, the natural gas pressure provided to the first compression stage 112. In some cases, the source regulator valve 124 may be adjusted to comprise a high pressure limit of less than about 350 psig, between about 5 psig to about 330 psig, between about 40 psig to about 330 psig, between about 275 psig to about 325 psig, and/or about 300 psig. In some cases, a pressure release valve 126 may be provided to selectively reduce pressure provided to the compressor 102, namely in this embodiment, the natural gas pressure provided to the first compression stage 112. In some cases, the pressure release valve 126 may be selected and/or adjusted to comprise a release pressure of less than about 350 psig, between about 5 psig to about 330 psig, between about 40 psig to about 330 psig, between about 275 psig to about 325 psig, and/or about 300 psig. In some embodiments, the pressure release valve 126 may be set to comprise a release pressure higher than the high pressure limit of the source regulator valve 124. In some cases, the pressure release valve 126 may operate to release natural gas to atmosphere or storage.

In some embodiments, a stage bypass 128 may be provided in selective fluid communication with the natural gas source 104 and an output of the second compression stage 114. The stage bypass 128 may comprise a stage bypass valve 130 operable to selectively open and close the stage bypass 128. The stage bypass 128 may further comprise a bypass check valve 132. Similarly, a second stage check valve 134 may be provided to prevent fluid from reaching the stage bypass 128 and/or the second compression stage 114 outlet from a storage feedback 136 that is in selective fluid communication with the storage tank 106 and the input to the third compression stage 116. A feedback valve 138 may be provided to selectively open and close the storage feedback 136. A feedback regulator valve 140 may be configured to comprise a high pressure limit equal to or less than a maximum pressure rating for an input of the third compression stage 116.

Figure 2A:
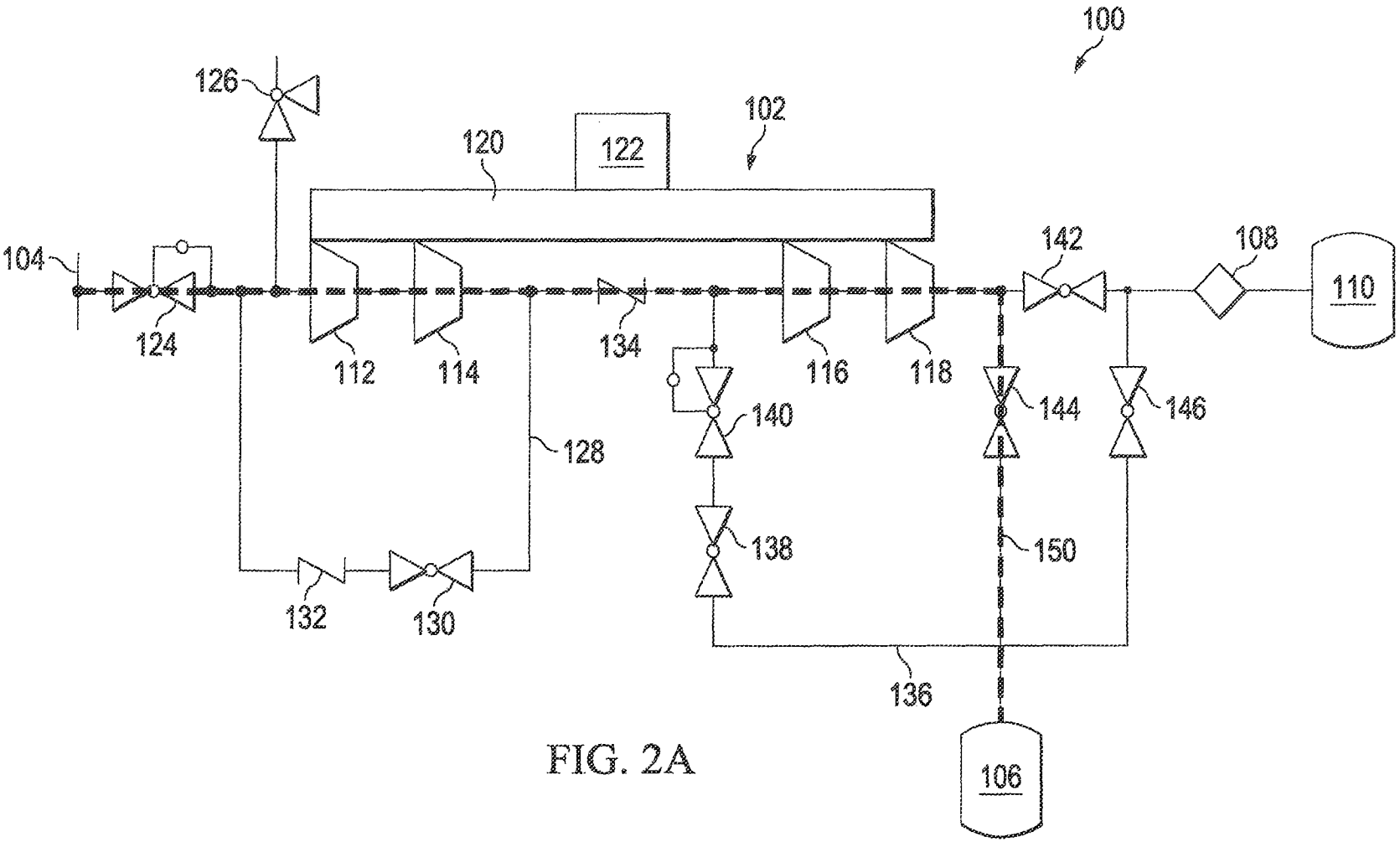
FIG. 2A is a schematic diagram of the CNG fueling system of FIG. 1 showing a flowpath utilized while receiving natural gas from a source, compressing the natural gas, and storing the natural gas in a storage tank.
Figure 2B:
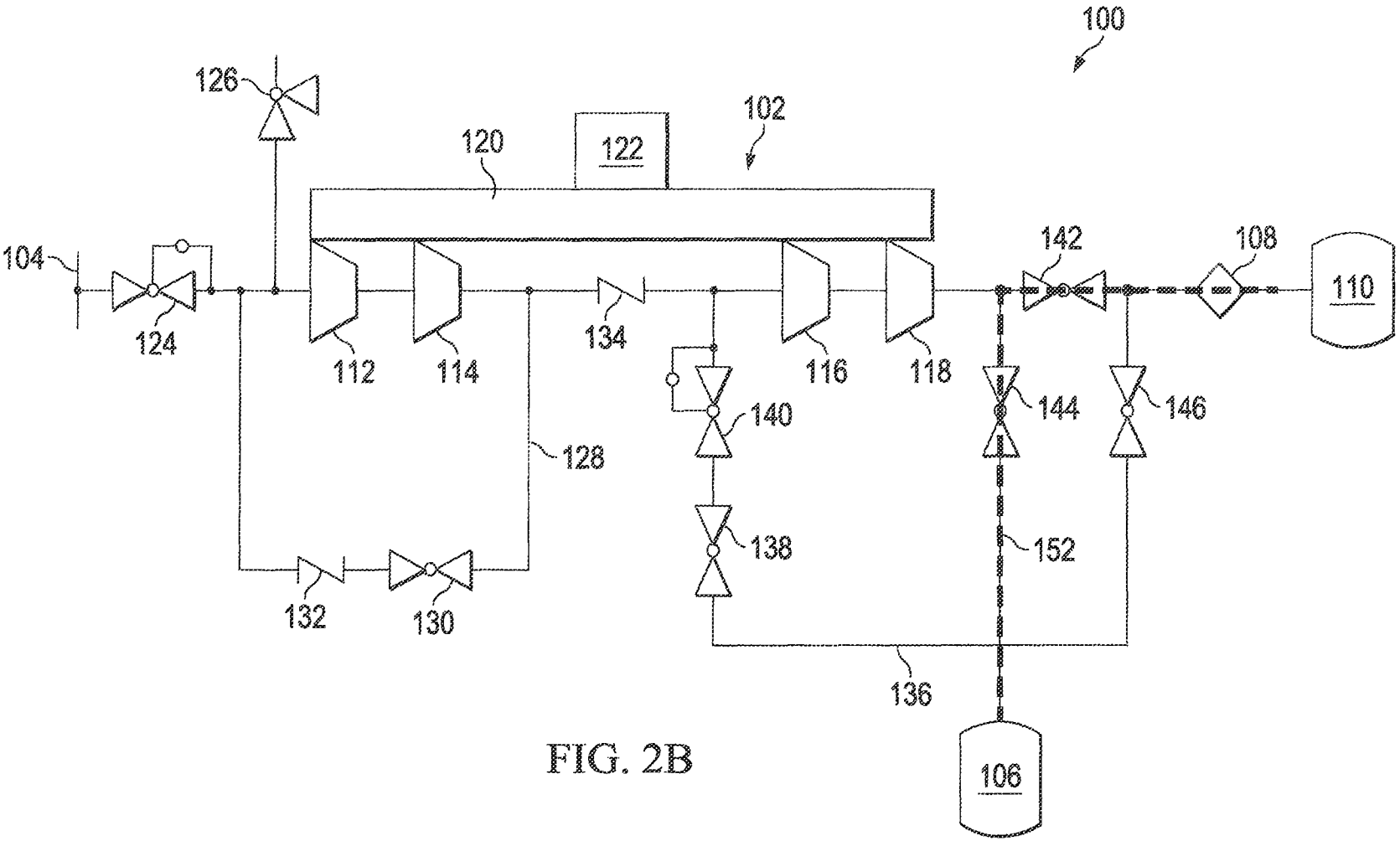
FIG. 2B is a schematic diagram of the CNG fueling system of FIG. 1 showing a flowpath utilized while transferring natural gas from a storage tank to a vehicle storage tank.
Figure 2C:
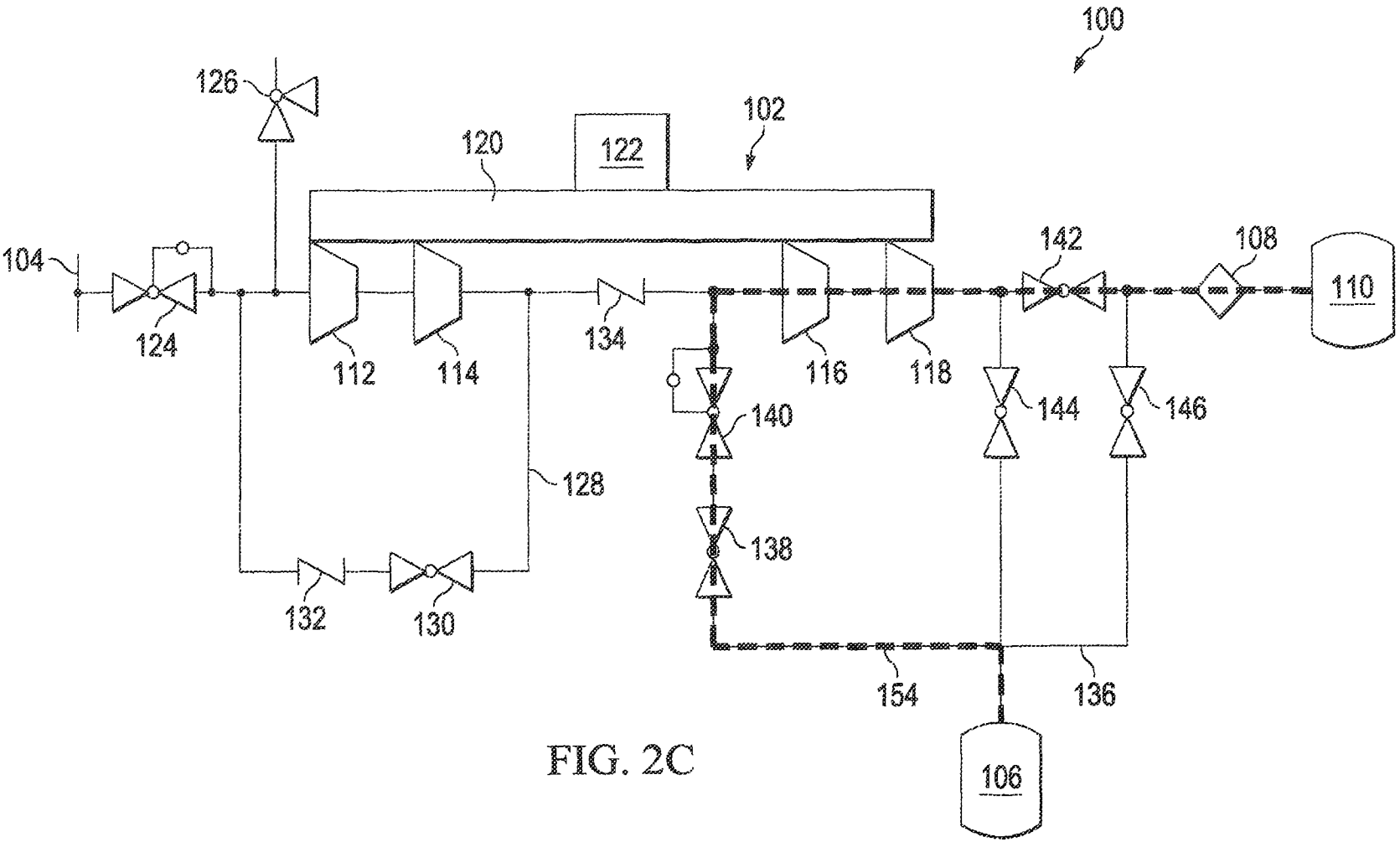
FIG. 2C is a schematic diagram of the CNG fueling system of FIG. 1 showing a flowpath utilized while providing natural gas from a storage tank to a compressor, compressing the natural gas, and transferring natural gas from the compressor to a vehicle storage tank.
Figure 2D:
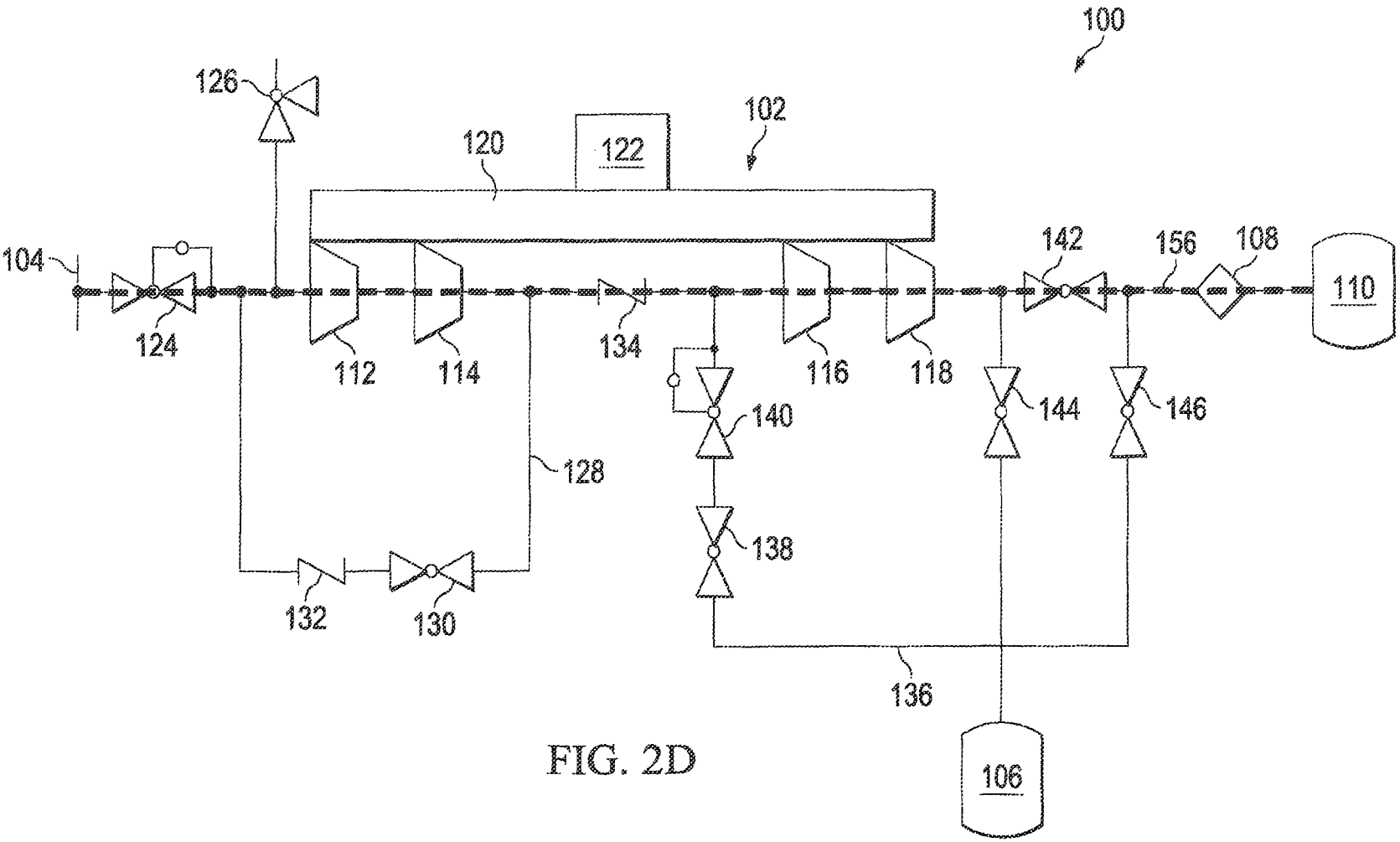
FIG. 2D is a schematic diagram of the CNG fueling system of FIG. 1 showing a flowpath utilized while receiving natural gas from a natural gas source, compressing the natural gas, and providing the compressed natural gas to a vehicle storage tank.

FIG. 2A is a schematic diagram of the CNG fueling system 100 of FIG. 1 showing a flowpath 150 that may be selectively utilized to receive natural gas from the natural gas source 104, compress natural gas using each of the compression stages 112, 114, 116, 118 of the compressor 102, and store the CNG in the storage tank 106. FIG. 2B is a schematic diagram of the CNG fueling system 100 of FIG. 1 showing a flowpath 152 that may be selectively utilized to transfer CNG from the storage tank 106 to a vehicle storage tank 110 via the dispenser 108. FIG. 2C is a schematic diagram of the CNG fueling system 100 of FIG. 1 showing a flowpath 154 that may be selectively utilized to provide CNG from the storage tank 106 to the compressor 102, further compress the CNG, and transfer the further compressed CNG from the compressor 102 to the vehicle storage tank 110 via the dispenser 108. In some embodiments, during operation of the compressor 102 as shown in FIG. 2C, the stage bypass valve 130 may be open to direct an output of the second compression stage 114 to an input of the first compression stage 112 thereby generally operating the first and second compression stages 112, 114 in an unloaded state while operating the third and fourth stages 116, 118 in a loaded state. FIG. 2D is a schematic diagram of the CNG fueling system 100 of FIG. 1 showing a flowpath 156 that may be selectively utilized to receiving natural gas from the natural gas source 104, compress the natural gas, and providing the CNG to the vehicle storage tank 110 via the dispenser 108.

In some embodiments, an output pressure of the first compression stage 112 may range from about 100 psig to about 1000 psig. In some embodiments, an output pressure of the second compression stage 114 may range from about 350 psig to about 1000 psig. In some embodiments, CNG may be supplied to the input of the third compression stage 116 at a pressure ranging from about 350 psig to about 1200 psig. In some embodiments, an output pressure of the third compression stage 116 may range from about 1000 psig to about 3000 psig. In some embodiments, CNG may be supplied to the input of the fourth compression stage 118 at a pressure ranging from about 1000 psig to about 3000 psig. In some embodiments, an output pressure of the fourth compression stage 118 may range from about 2000 psig to about 5000 psig.

In this embodiment, an output of the fourth compression stage 118 and the dispenser 108 may be selectively connected and/or disconnected from fluid communication with each other by a valve 142. Further, the storage tank 106 may be selectively connected in fluid communication with an input of the valve 142 via a valve 144. Similarly, the storage tank 106 may be selectively connected and/or disconnected in fluid communication with an output of the valve 142 via a valve 146.

Figure 3:
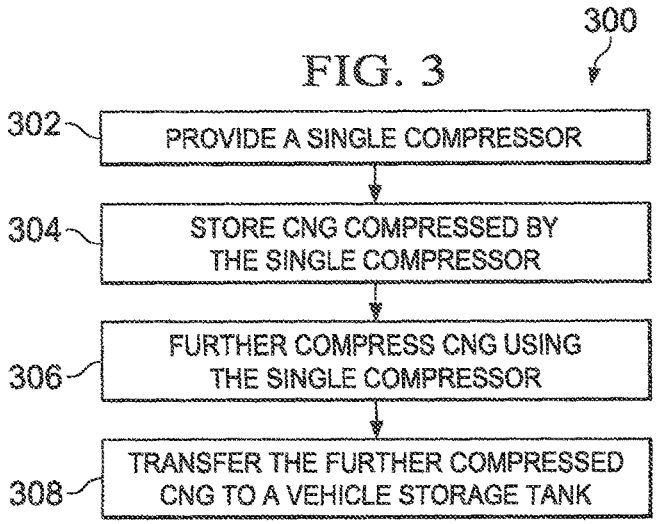
FIG. 3 is a flowchart of a method of transferring fuel to a vehicle storage tank according to an embodiment of the disclosure.

Referring now to FIG. 3, a method 300 of transferring fuel to a vehicle storage tank is shown according to an embodiment of the disclosure. The method 300 may begin at block 302 by providing a single compressor, such as a compressor 102. In some embodiments, a grouping of gas compression components may be a single compressor if at least one of (1) the gas compression components (i.e. pistons and/or the like) are driven by a single and/or shared rotating input, such as, but not limited to, a crankshaft of a power transfer device 120 and (2) the gas compression components and/or the power transfer devices are driven by a single and/or shared compressor driver, such as, but not limited to, a single compressor driver 122 (i.e. electric motor). The method 300 may continue at block 304 by storing CNG compressed by the single compressor. The method 300 may continue at block 306 by further compressing the stored CNG using the single compressor. The method 300 may continue at block 308 by transferring the further compressed CNG to a vehicle storage tank 110.

In some cases, a CNG fueling system 100 may operate as shown in FIG. 2A until the storage tank 106 has reached a maximum capacity at a selected CNG pressure, in some cases, about 4500 psig to about 5000 psig. With the storage tank 106 full, the compressor 102 may turn off. Next, CNG may be provided to a vehicle storage tank 110 from the storage tank 106 as shown in FIG. 2B until the storage tank 106 and the vehicle storage tank 110 either equalize or until a mass flow rate or transfer rate of CNG falls below a predetermined threshold value. In some embodiments, when the above-described equalization or predetermined threshold value is reached, or when a lower predetermined pressure of the storage tank 106 is reached, the CNG fueling system 100 may operate as shown in FIG. 2C to direct CNG from the storage tank 106 to at least one of the compression stages 112, 114, 116, 118 of the compressor 102 and transfer the further compressed CNG from the running compressor 102 to the vehicle storage tank 110. In some embodiments, after another predetermined lower pressure threshold of the storage tank 106 is reached, the system may continue to provide CNG to the vehicle storage tank 110 by operating as shown in FIG. 2D until the vehicle storage tank 110 is full as indicated by pressure, weight, change in mass flow rate, and/or any other suitable determinative factor. In the manner described above, a single compressor may be utilized to quickly fill a vehicle storage tank with CNG even when the natural gas source is provided at a relatively low pressure.

Figure 4:
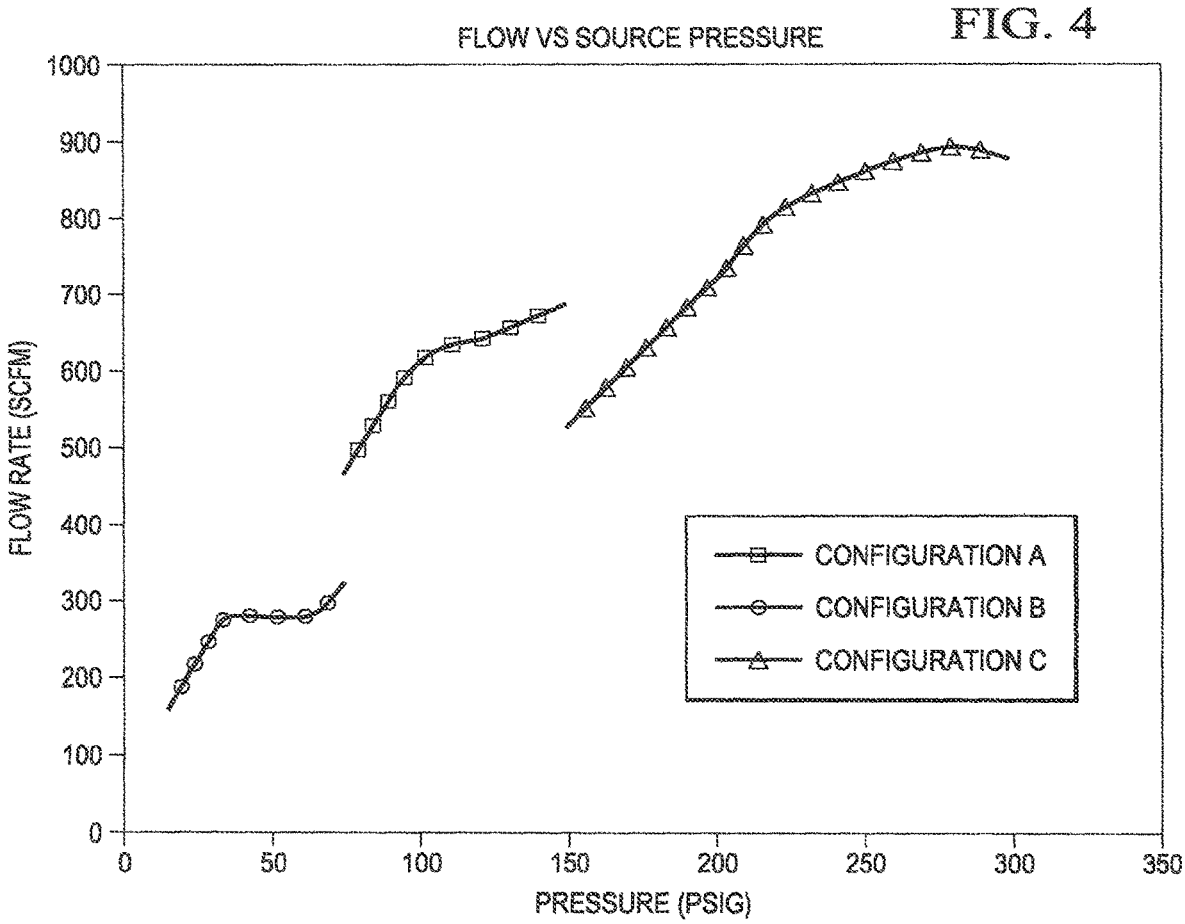
FIG. 4 is a chart comparing gas flow versus natural gas source pressure for three different configurations of the CNG fueling system of FIG. 1.
Figure 5:
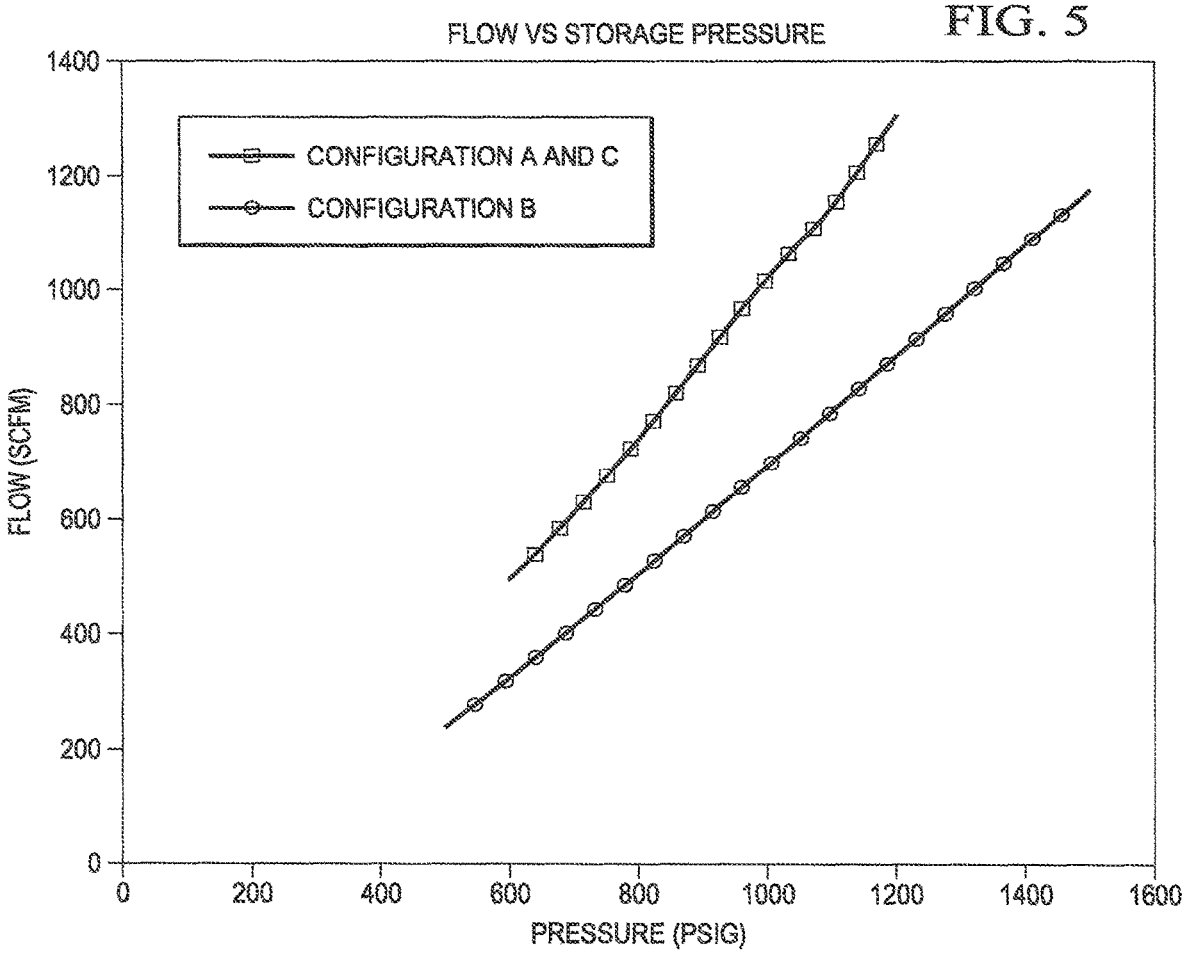
FIG. 5 is a chart comparing gas flow versus storage tank pressure for the three different CNG fueling system configurations of FIG. 4.

Referring now to FIG. 4, a chart comparing gas flow versus natural gas source pressure for three different configurations of the CNG fueling system of FIG. 1. FIG. 5 is a chart comparing gas flow versus storage tank pressure for the three different CNG fueling systems substantially similar to the CNG fueling system 100 configurations of FIG. 1. In each of FIGS. 4 and 5, reference is made to configurations A, B, and C. Each of configurations A, B, and C illustrate operation of CNG fueling systems 100 with an electric motor compressor drive 122 driving a single and/or shared crankshaft of a power transfer device 120 at 1800 rpm with a 3 inch stroke length. The differences between configurations A, B, and C are the compressor driver 122 size (horsepower), the number of compression stages, and the cylinder bore diameter of the compressions stages of the separable CNG compressor 102. Configuration A comprises a 250 HP electric motor, a 1st stage 7¼" bore, a 2nd stage 4⅛" bore, a 3rd stage 3⅜" bore, and a 4th stage 1¾" bore, where CNG is fed back to the 3rd and 4th stage during operation substantially similar to that shown in FIG. 2C. Configuration B comprises a 125 HP electric motor, a 1st stage 8" bore, a 2nd stage 4⅛" bore, a 3rd stage 3" bore, and a 4th stage 1½ bore, where CNG is fed back to the 3rd and 4th stage during operation substantially similar to that shown in FIG. 2C. Configuration C comprises a 250 HP electric motor, a 1st stage 4⅛" bore, a 2nd stage 3⅜" bore, and a 3rd stage 1¾" bore, where CNG is fed back to the 2nd and 3rd stage during operation substantially similar to that shown in FIG. 2C.

Figure 6:
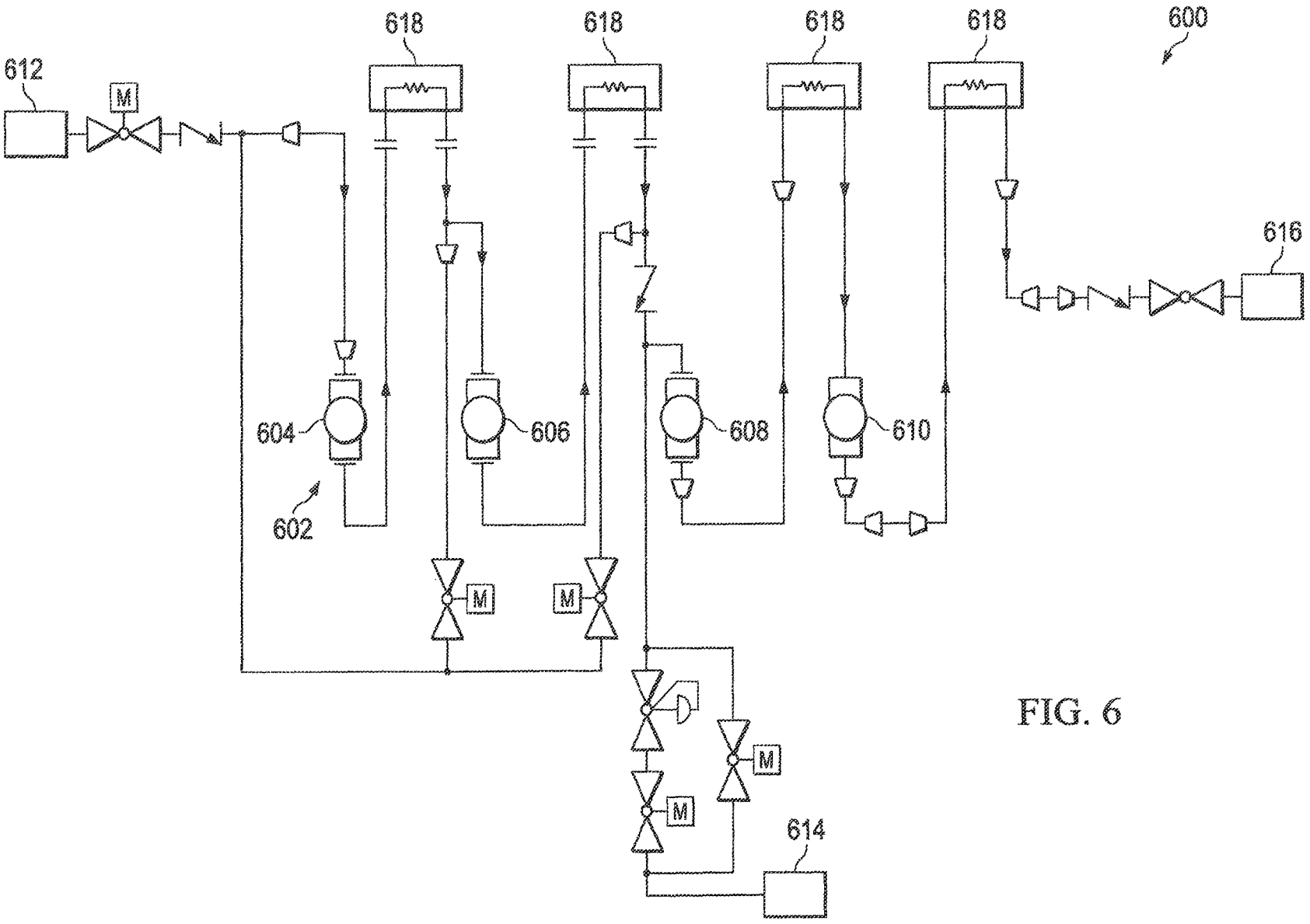
FIG. 6 is a schematic diagram of a CNG fueling system according to another embodiment of the disclosure.

FIG. 6 is a schematic diagram of a CNG fueling system 600 according to another embodiment of the disclosure. CNG fueling system 600 is substantially similar to CNG fueling system 100. CNG fueling system 600 comprises a single compressor 602 comprising a first compression stage 604, a second compression stage 606, a third compression stage 608, and a fourth compression stage 610. Also like CNG fueling system 100, CNG fueling system 600 is configured to receive natural gas from a relatively low pressure natural gas source 612 having a pressure of about 330 psig or less. The CNG fueling system 600 may be configured to compress natural gas and deliver the CNG to each of a storage tank 614 and a vehicle storage tank 616. The CNG fueling system 600 may be operated substantially in accordance with the method 300 to quickly fuel a vehicle storage tank 616. CNG fueling system 600 further comprises a plurality of heat exchangers 618 through which CNG may be passed to manage a temperature of the CNG as it moves relative to the compression stages 604, 606, 608, 610.

Figure 7:
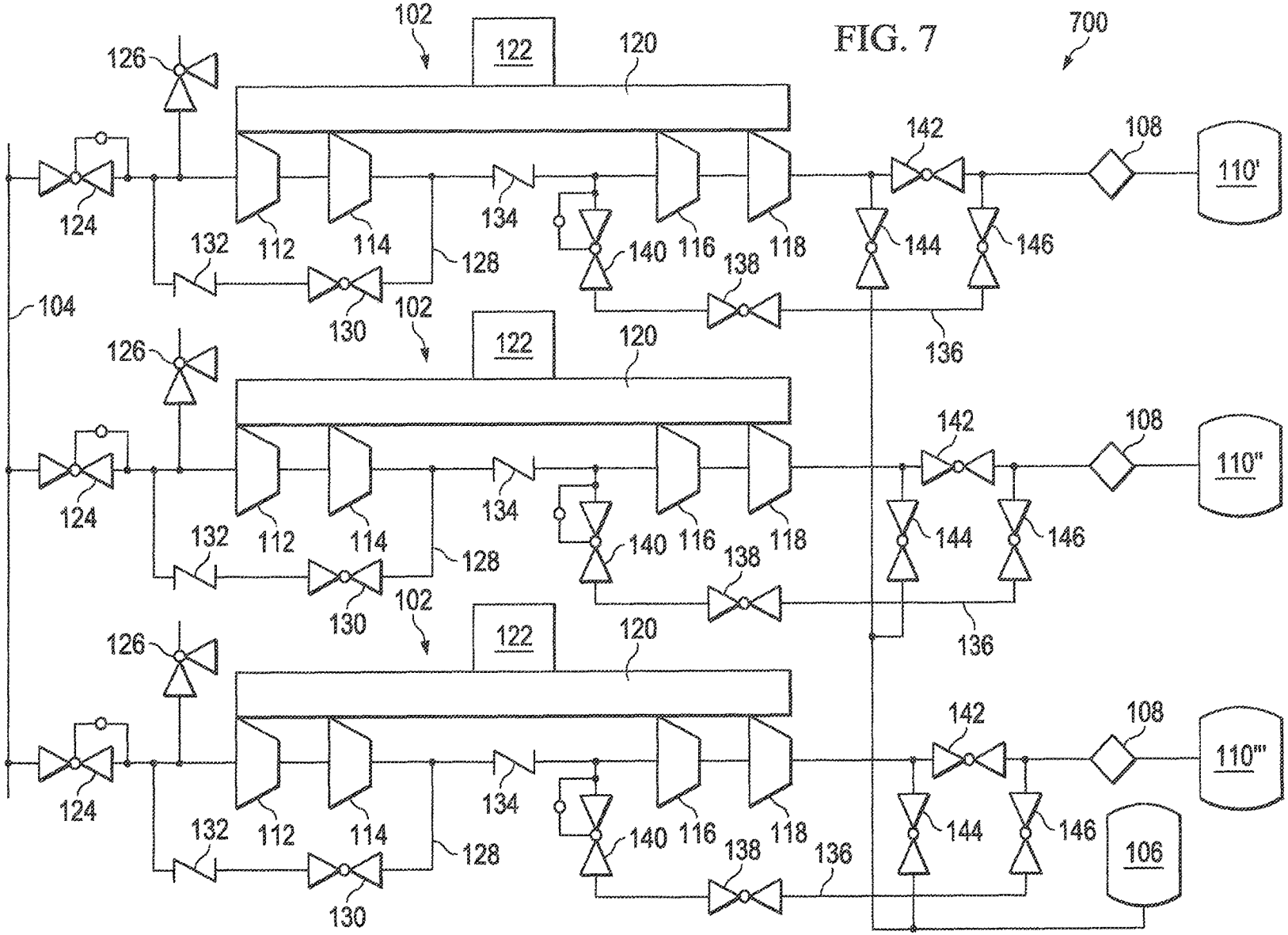
FIG. 7 is a schematic diagram of another CNG fueling system according to another embodiment of the disclosure.

Referring now to FIG. 7, a schematic diagram of a CNG fueling system 700 according to another embodiment of the disclosure is shown. CNG fueling system 700 comprises a plurality of compressors 102 that are substantially similar to compressors 102 of CNG fueling system 100. Each compressor 102 may be provided natural gas from the natural gas source 104. In this embodiment, multiple vehicle storage tanks 110', 110", 110'" may be provided CNG by CNG fueling system 700 substantially independently of each other. In this embodiment, each compressor 102 may be configured to deliver CNG to a shared and/or same storage tank 106. In alternative embodiments, a CNG storage selection header may be provided that comprises any necessary pipes, valves, and/or control systems useful in selectively directing a CNG output from any combination of compressors 102 to storage tank 106 and/or to any combination of a plurality of storage tanks 106. In alternative embodiments, a dispenser selection header may be provided that comprises any necessary pipes, valves, and/or control systems useful in selectively directing a CNG output from any combination of compressors 102 to any combination of the plurality of dispensers 108.

Figure 8:
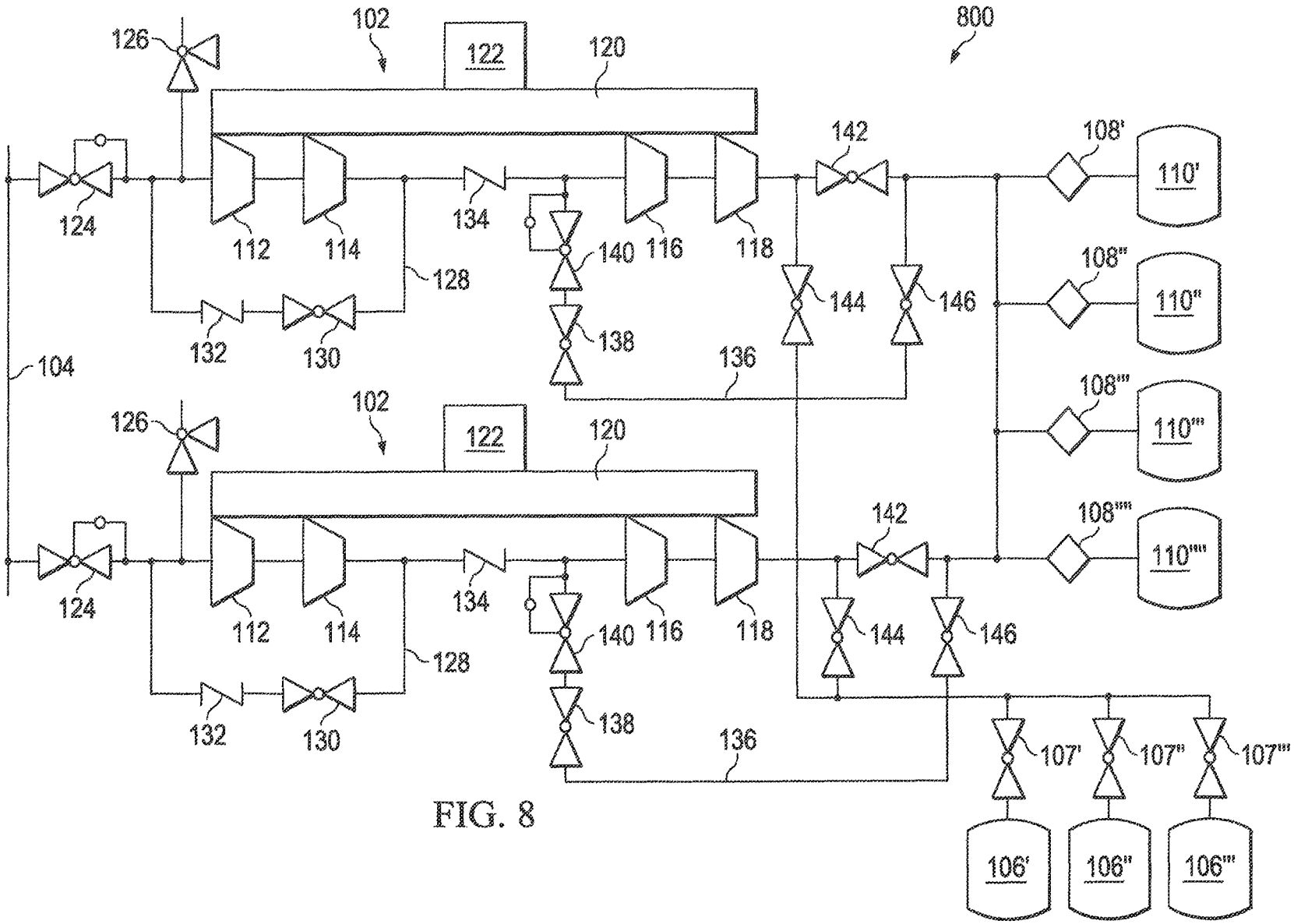
FIG. 8 is a schematic diagram of another CNG fueling system according to another embodiment of the disclosure.

Referring now to FIG. 8, a schematic diagram of a CNG fueling system 800 according to another embodiment of the disclosure is shown. CNG fueling system 800 comprises a plurality of compressors 102 that are substantially similar to compressors 102 of CNG fueling system 100. Each compressor 102 may be provided natural gas from the natural gas source 104. In this embodiment, multiple vehicle storage tanks 110', 110", 110'", 110'" may be provided CNG by CNG fueling system 800 substantially independently of each other. In this embodiment, each compressor 102 may be configured to deliver CNG to a shared and/or same storage tank 106. In this embodiment, each storage tank 106', 106", 106'" is provided with a tank valve 107', 107", 107'", respectively, to allow any combination of selections of storage tanks 106', 106", 106'" to receive and/or provide CNG. In alternative embodiments, a CNG storage selection header may be provided that comprises any necessary pipes, valves, and/or control systems useful in selectively directing a CNG output from any combination of compressors 102 to storage tanks 106', 106", 106'". In alternative embodiments, a dispenser selection header may be provided that comprises any necessary pipes, valves, and/or control systems useful in selectively directing a CNG output from any combination of compressors 102 to any combination of the plurality of dispensers 108', 108", 108'", 108"".

Figure 9:
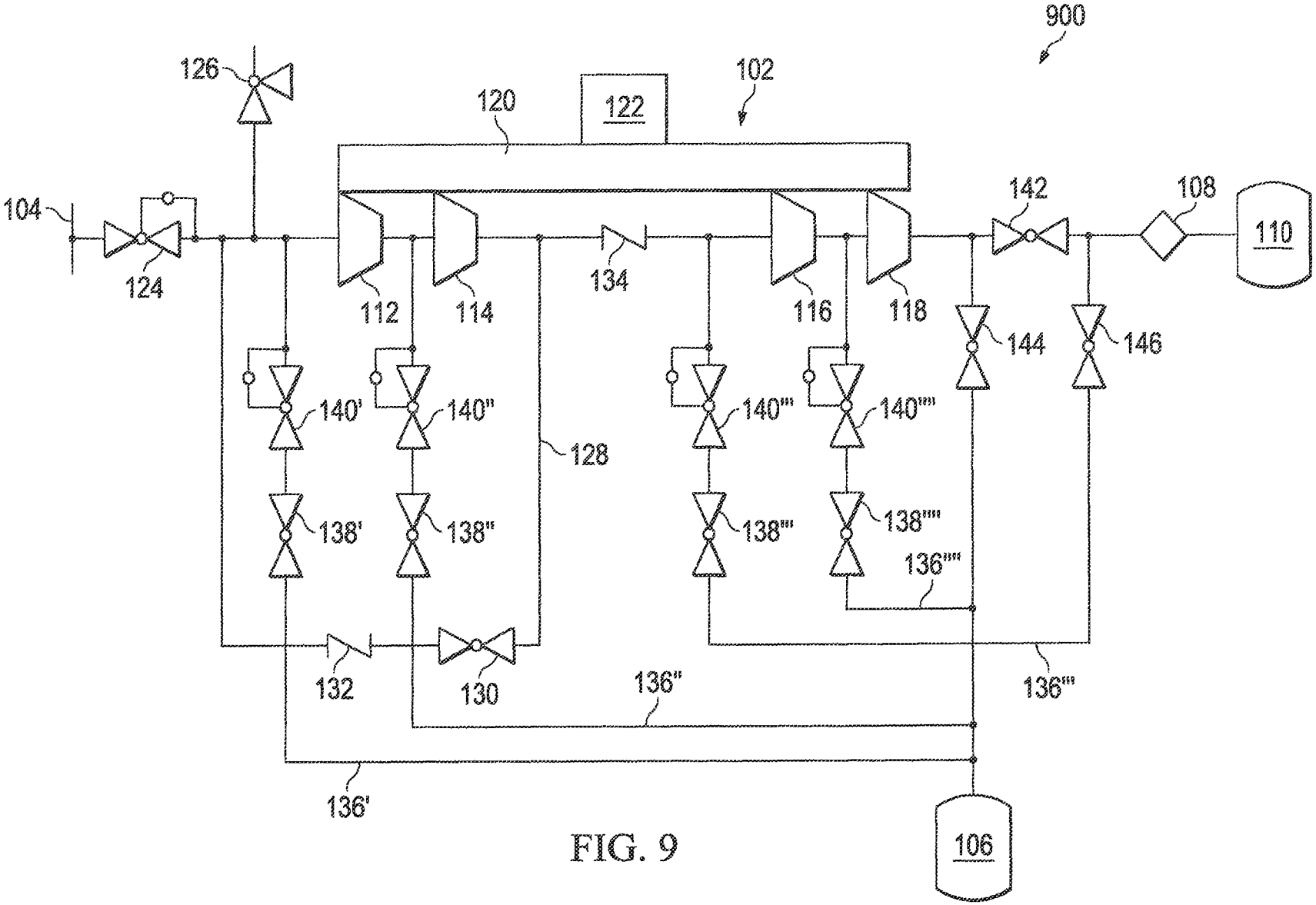
FIG. 9 is a schematic diagram of another CNG fueling system according to another embodiment of the disclosure.

Referring now to FIG. 9, a schematic diagram of a CNG fueling system 900 according to another embodiment of the disclosure is shown. CNG fueling system 900 is substantially similar to CNG fueling system 100. However, CNG fueling system 900 comprises a plurality of storage feedbacks 136', 136", 136'", 136"". In this embodiment, each storage feedback 136', 136", 136'", 136"" is associated with their own dedicated feedback valves 138 (namely feedback valves 138', 138", 138'", 138"", respectively) and feedback regulator valves 140 (namely feedback regulator valves 140', 140", 140'", 140"", respectively). In some embodiments, the CNG fueling system 900 may control feedback valves 138', 138", 138'", 138"" to selectively feed CNG back from storage tank 106 to any combination of compression stages 112, 114, 116, 118, sequentially and/or simultaneously. In some embodiments, additional CNG storage tanks may be provided and selectively filled to comprise CNG at pressures higher or lower than storage tank 106. In alternative embodiments, a feedback header may be provided that comprises any necessary pipes, valves, and/or control systems useful in selectively directing a CNG output from any combination of storage tanks 106 to any combination of the plurality of compression stages 112, 114, 116, 118 via the storage feedbacks 136', 136", 136''', 136''''.

In some embodiments, the CNG fueling system 900 may be operated to feed CNG back from storage tank 106 to fourth compression stage 118 via storage feedback 136'''' until the pressure of the CNG supplied by the storage tank 106 is reduced to a first predetermined threshold pressure. In some embodiments, the first predetermined threshold pressure may be associated with a lower end of a desirable input pressure range of the fourth compression stage 118. Once the first predetermined threshold pressure is reached, the CNG fueling system 900 may be operated to discontinue feeding CNG back from storage tank 106 to fourth compression stage 118.

In some embodiments, the CNG fueling system 900 may be operated to feed CNG back from storage tank 106 to third compression stage 116 via storage feedback 136''' until the pressure of the CNG supplied by the storage tank 106 is reduced to a second predetermined threshold pressure. In some embodiments, the second predetermined threshold pressure may be associated with a lower end of a desirable input pressure range of the third compression stage 116. Once the second predetermined threshold pressure is reached, the CNG fueling system 900 may be operated to discontinue feeding CNG back from storage tank 106 to third compression stage 116.

In some embodiments, the CNG fueling system 900 may be operated to feed CNG back from storage tank 106 to second compression stage 114 via storage feedback 136" until the pressure of the CNG supplied by the storage tank 106 is reduced to a third predetermined threshold pressure. In some embodiments, the third predetermined threshold pressure may be associated with a lower end of a desirable input pressure range of the second compression stage 114. Once the third predetermined threshold pressure is reached, the CNG fueling system 900 may be operated to discontinue feeding CNG back from storage tank 106 to second compression stage 114.

In some embodiments, the CNG fueling system 900 may be operated to feed CNG back from storage tank 106 to first compression stage 112 via storage feedback 136' until the pressure of the CNG supplied by the storage tank 106 is reduced to a fourth predetermined threshold pressure. In some embodiments, the fourth predetermined threshold pressure may be associated with a lower end of a desirable input pressure range of the first compression stage 112. Once the fourth predetermined threshold pressure is reached, the CNG fueling system 900 may be operated to discontinue feeding CNG back from storage tank 106 to first compression stage 112. In some embodiments, once the CNG fueling system 900 discontinues feeding CNG back from storage tank 106 to first compression stage 112, the CNG fueling system 900 may begin operation substantially similar to that shown in FIG. 2D to complete fueling a vehicle storage tank 110.

While the CNG fueling systems disclosed above are described with specificity, it will be appreciated that alternative embodiments of CNG fueling systems are contemplated that comprise any necessary header and/or fluid distribution systems useful in selectively connecting any of the component parts of the CNG fueling systems in any combination. For example, alternative embodiments may comprise headers, valves, pipes, control systems, and/or any other suitable device for selectively connecting one or more storage tanks to one or more compressors, compression stages, dispensers, vehicle storage tanks, alternative natural gas supplies, and/or any other suitable interface. Similarly, alternative embodiments may comprise headers, valves, pipes, control systems, and/or any other suitable device for selectively connecting one or more compressors and/or compression stages to one or more compressors, compression stages, dispensers, vehicle storage tanks, alternative natural gas supplies, and/or any other suitable interface. Similarly, alternative embodiments may comprise headers, valves, pipes, control systems, and/or any other suitable device for selectively connecting one or more dispensers to one or more compressors, compression stages, dispensers, vehicle storage tanks, alternative natural gas supplies, and/or any other suitable interface. Similarly, alternative embodiments may comprise headers, valves, pipes, control systems, and/or any other suitable device for selectively connecting one or more vehicle storage tanks to one or more compressors, compression stages, dispensers, alternative natural gas supplies, and/or any other suitable interface. In some embodiments, the above-described systems and methods may comprise systems and/or methods for being implemented in an automated, semi-automated, programmed, electronically controlled, manual, and/or computer controlled nature. In some embodiments, the above-described systems and methods may be remotely controlled and/or robotically assisted.

In some cases, CNG stored in a storage tank, such as storage tank 106, may experience a reduction in temperature. One reason CNG stored in a storage tank may be cooled is because the storage tank 106 may be located above ground and exposed to cold ambient temperatures. In some geographic locations, the ambient temperatures may be as low as −20 degrees Fahrenheit or lower. Secondly, the stored CNG may experience a temperature decrease because of the Joule-Thompson effect according to which gasses are cooled as they expand. Accordingly, as CNG is removed from the storage tank, the removed CNG expands and cools and also causes some cooling of CNG remaining in the storage tank. In some embodiments, as the compressor pulls gas from storage, the storage tank may reduce from about 4000 psig to about 1000 psig. This 3000 psig decrease will cause the gas left in storage to decrease in temperature. The storage vessel may eventually warm the CNG that remains in storage, but the gas that is provided to the compressor may remain relatively cooler. Without means to prevent otherwise, the temperature of the CNG provided to the compressor may be undesirably cool, and that temperature depends how fast the gas is removed from the storage tank. Feeding cold gas to the compressor can be problematic. In some cases, cold gas can overload a driver of the compressor since colder gas is denser and more power is required to compress it. In other cases, the cold gas may shift a load on a piston rod of the compressor when gas flow is increased, thereby causing problems with the piston rod. Still further, the cool gas may reduce system equipment temperatures to near or below minimum design metal temperatures (MDMT) which can cause metal to become brittle and increase a risk of fracture. Accordingly, the embodiments of FIGS. 10-13 are disclosed which provide for warming the CNG temperature before providing it to the compressor from the storage tank.

Figure 10:
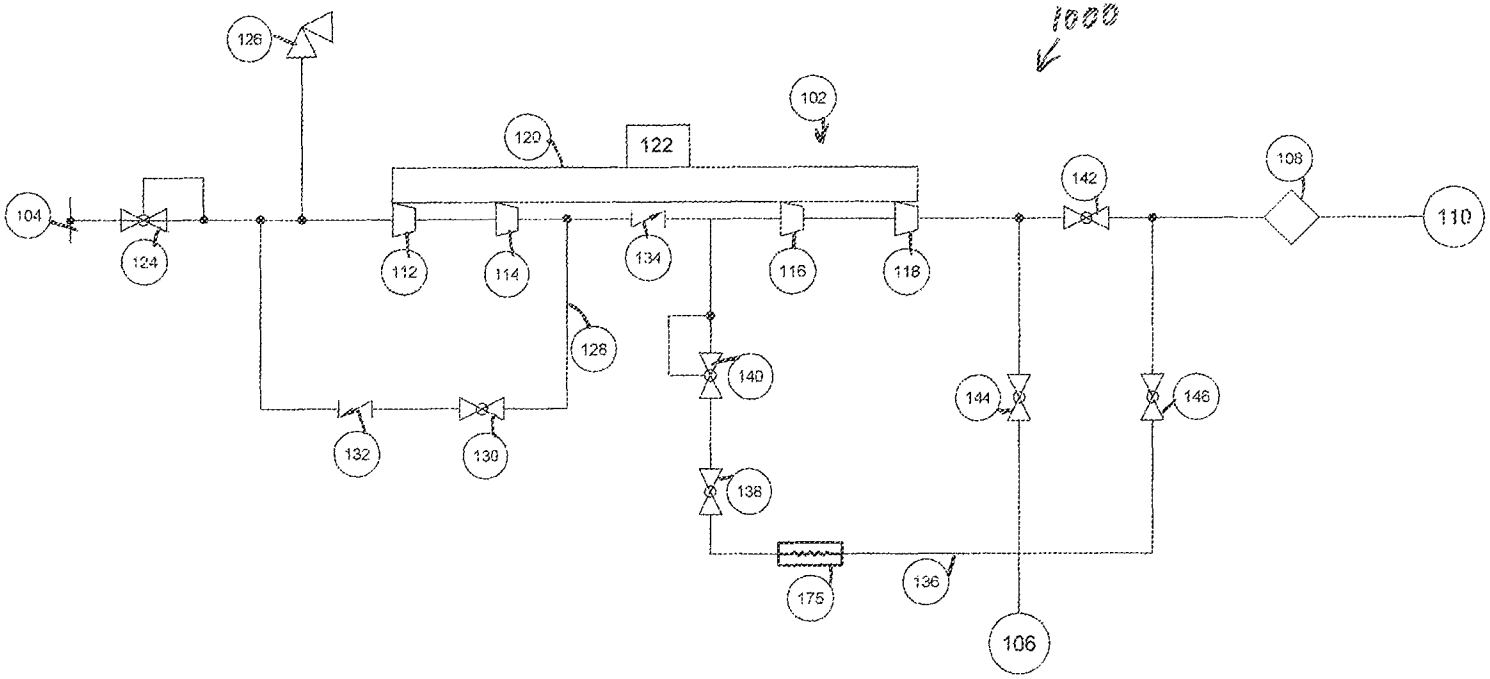
FIG. 10 is a schematic diagram of another CNG fueling system according to another embodiment of the disclosure.

Referring now to FIG. 10, a schematic of a CNG fueling system 1000 is shown according to an embodiment of the disclosure. The CNG fueling system 1000 is substantially similar to the CNG fueling system 100 but for the addition of the heat exchanger 175 disposed along the storage feedback 136. In this embodiment, the heat exchanger 175 is disposed between the storage tank 106 and the feedback valve 138. The heat exchanger 175 can comprise any suitable type of heat exchanger that can warm the CNG flowing from the storage tank 106 to the feedback valve 138. In some cases, the heat exchanger 175 may comprise an electrical heating element, a furnace, a fan, and/or any other suitable system or device. In some embodiments, the heat exchanger 175 can be operated to provide varying degrees of heat as a function of the ambient temperature, CNG temperature, and/or a desired temperature of CNG being delivered to the compressor 102.

Figure 11:
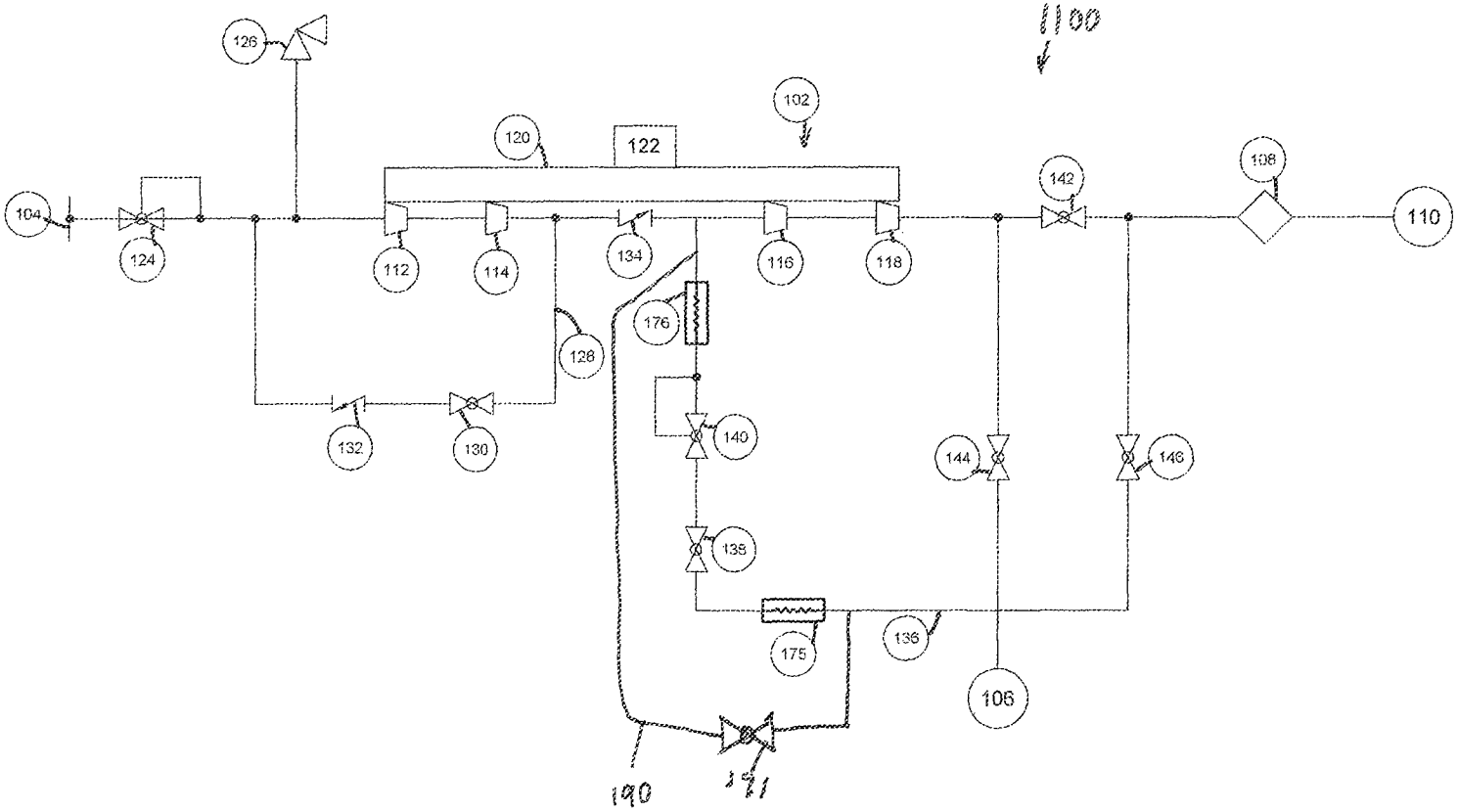
FIG. 11 is a schematic diagram of another CNG fueling system according to another embodiment of the disclosure.

Referring now to FIG. 11, a schematic of a CNG fueling system 1100 is shown according to an embodiment of the disclosure. The CNG fueling system 1100 is substantially similar to the CNG fueling system 1000 but for the addition of the heat exchanger 176 also disposed along the storage feedback 136. In this embodiment, the heat exchanger 176 is disposed between the feedback regulator valve 140 and the compressor 102. More specifically, the heat exchanger 176 is disposed between feedback regulator valve 140 and the third compression stage 116. Like heat exchanger 175, heat exchanger 176 may comprise an electrical heating element, a furnace, a fan, and/or any other suitable system or device.

Figure 12:
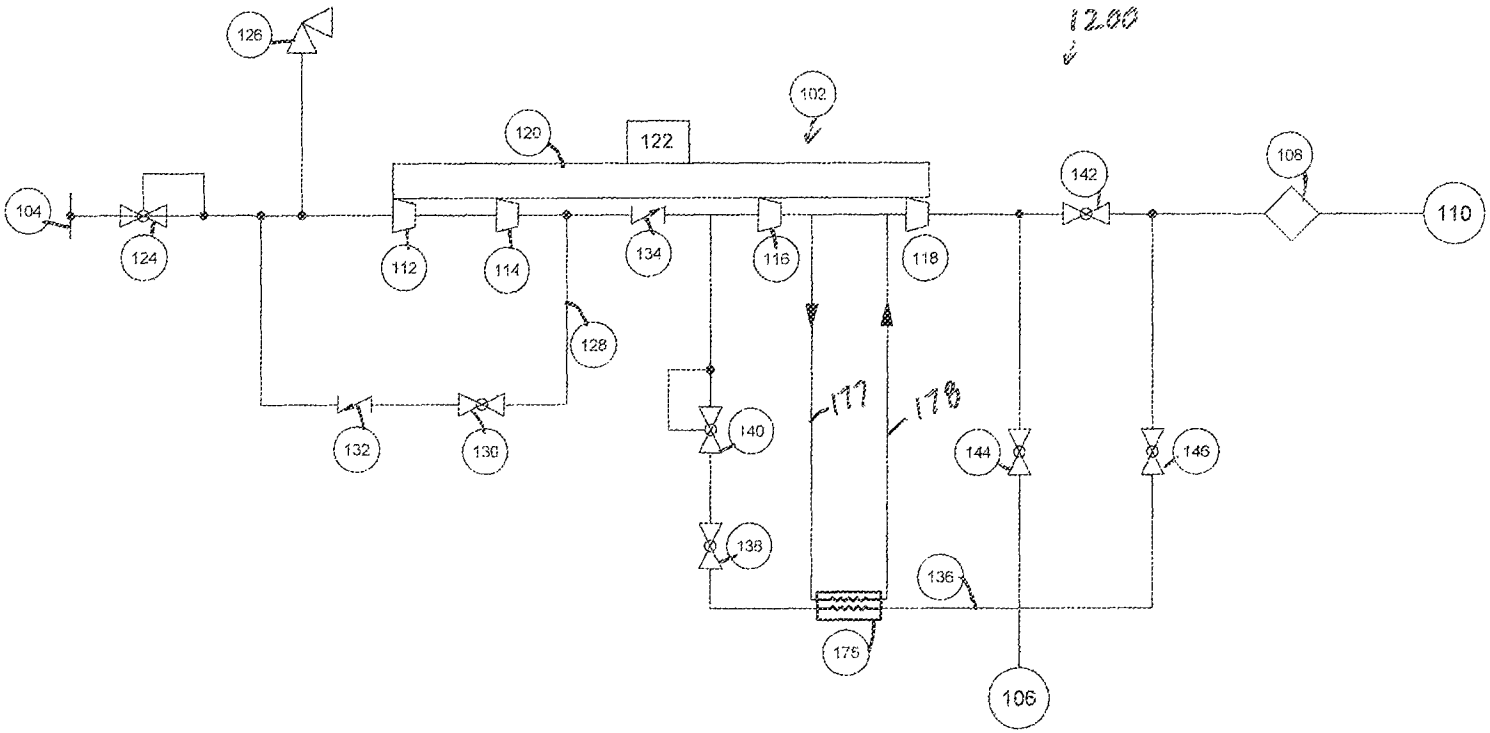
FIG. 12 is a schematic diagram of another CNG fueling system according to another embodiment of the disclosure.

Referring now to FIG. 12, a schematic of a CNG fueling system 1200 is shown according to an embodiment of the disclosure. The CNG fueling system 1200 is substantially similar to the CNG fueling system 1000, but with the addition of a heater input line 177 and a heater output line 178. In this embodiment, the heater input line 177 provides hot gas from an output of the third compression stage 116 to the heat exchanger 175 and the heater output line 178 returns hot gas (albeit potentially slightly cooler than when first supplied to the heat exchanger 175) to the compressor 102 and to an input of the fourth compression stage 118. In some embodiments, the heat exchanger 175 may comprise a pipe-in-pipe type heat exchanger. In some cases, during operation of the heat exchanger 175 to warm CNG as it is provided to the third compression stage 116, the first compression stage 112 and the second compression stage 114 may be inactive or underutilized.

Figure 13:
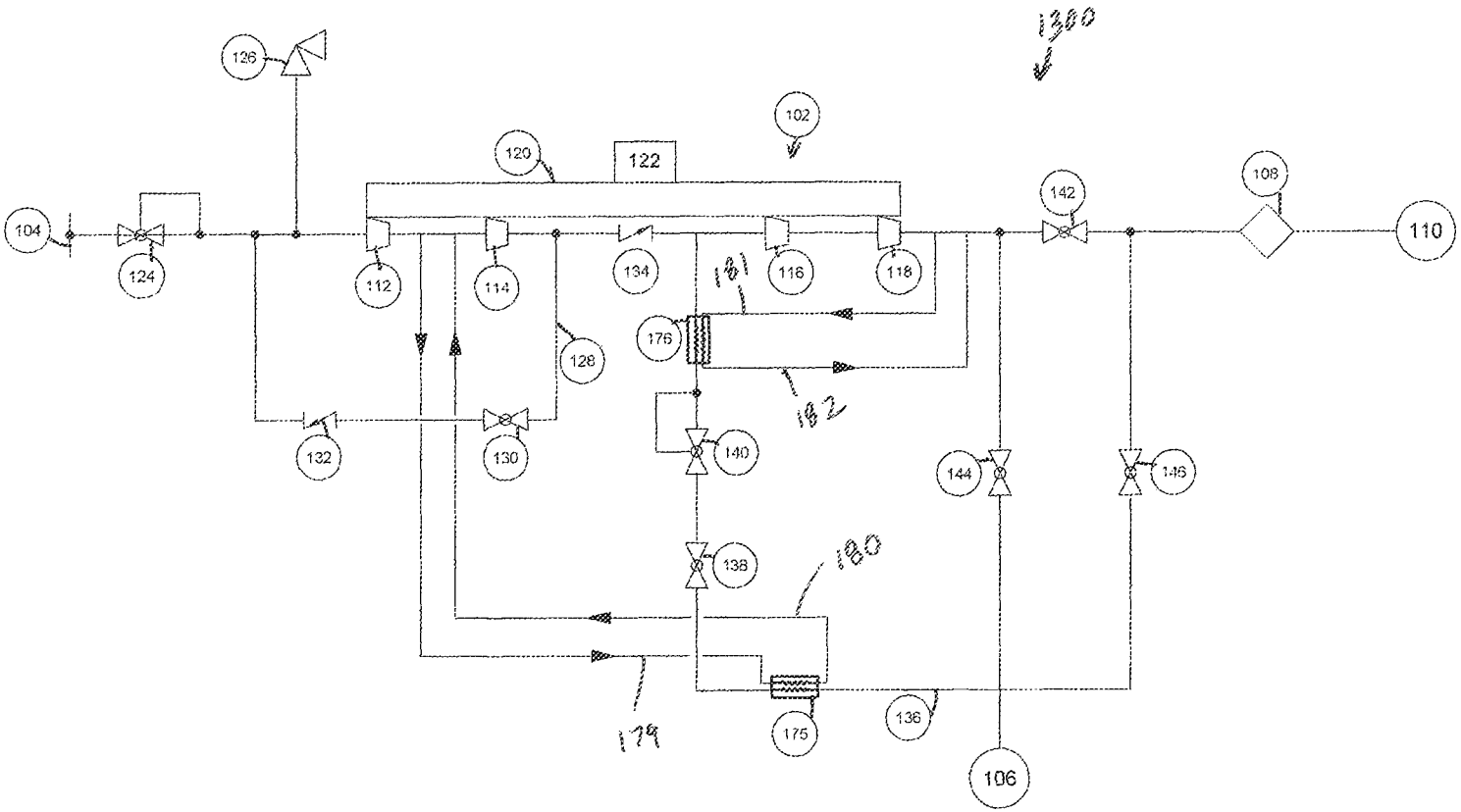
FIG. 13 is a schematic diagram of another CNG fueling system according to another embodiment of the disclosure.

Referring now to FIG. 13, a schematic of a CNG fueling system 1300 is shown according to an embodiment of the disclosure. The CNG fueling system 1300 is substantially similar to the CNG fueling system 1100, but with the addition of a heater input lines 179, 181 and heater output lines 180, 182. In this embodiment, the heater input line 179 provides hot gas from an output of the first compression stage 112 to the heat exchanger 175 and the heater output line 180 returns hot gas (albeit potentially slightly cooler than when first supplied to the heat exchanger 175) to the compressor 102 and to an input of the second compression stage 114. In this embodiment, the heater input line 181 provides hot gas from an output of the fourth compression stage 118 to the heat exchanger 176 and the heater output line 182 returns hot gas (albeit potentially slightly cooler than when first supplied to the heat exchanger 175) to the output of the fourth compression stage 118. In some embodiments, the heat exchangers 175, 176 may comprise pipe-in-pipe type heat exchangers, but any other suitable heat exchanger type is contemplated. In the extreme case where CNG pressure of the storage tank 106 drops from 4000 psig to about 600 psig, a 100 degree Fahrenheit temperature drop may occur and if the ambient temperature is below 80 degrees Fahrenheit, a dangerously low CNG and system temperature of below −20 degrees Fahrenheit may occur which is lower than the MDMT for most carbon steels. Accordingly, heat exchanger 175 is utilized to heat the gas up before further dropping pressure and temperature at feedback regulator valve 140. Thereafter, heat exchanger 176 can further heat the CNG.

Referring back to FIG. 11, in some embodiments, a cool gas bypass 190 may be provided that selectively receives cool CNG from upstream relative to the heat exchanger 175 and provides the cool gas downstream relative to the heat exchanger 176. In some embodiments, a mixer valve 191 can be modulated to selected positions to provide a desired amount of cool CNG to mix with the warmed CNG exiting the heat exchanger 176. In other words, by providing a source of cool gas and a means for throttling the amount of cool gas to be mixed with warmer gas, CNG of a desired temperature can be provided to the compressor 102. Accordingly, this disclosure contemplates utilizing heat generated by the compressor 102 to warm CNG exiting the storage tank 106 and further contemplates fine tuning and/or otherwise adjusting a temperature of CNG to be provided to the compressor 102 by mixing the warmed CNG with relatively cooler gas from the storage tank 106. Furthermore, by utilizing a feedback regulator valve 140, the allowable storage pressure of the storage tank 106 can be much higher than the maximum desired input pressure of the input of the third compression stage 116, thereby allowing use of a standard four stage compressor rather than requiring higher rated compression stages capable of handling the maximum storage pressure of the storage tank 106.

In some embodiments, a CNG system can be transitioned from operating only third compression stage 116 and fourth compression stage 118 (while drawing CNG from storage tank 106). In some cases, an input pressure to the third compression stage 116 can be higher while drawing CNG from storage tank 106 as compared to when drawing from the second stage 114 during four stage operation. To transition from the above-described two stage operation to four stage operation, the CNG supply from the storage tank 106 can be shut off (such as by closing feedback valve 138). As the pressure supplied to third compression stage 116 drops, it will approach a pressure that is typical for four stage operation. Once the pressure is substantially the same as four stage operation, the first compression stage 112 and the second compression stage 114 can be activated, thereby initiating four stage operation from a two stage operation in a very smooth manner.

In some cases, it may be desirable to manage the gas pressure present at the input of the various compression stages, especially when changing between two stage operation and four stage operation. One potential advantage of managing the pressure at the inputs of the various compression stages is to reduce the horsepower required to operating a compressor, such as compressor 102, when less than all the compression stages are being utilized to provide significant compression. The horsepower required to operate the compressor 102 can be reduced by reducing a volume of gas present in the compressor 102. Another potential benefit of managing the gas pressure within the compressor 102 is to provide gradual changes in pressure as opposed to sudden and drastic pressure changes associated with transitioning between four stage operation and two stage operation, thereby reducing shock and related wear and tear on the compressor 102 components.

Figure 14:
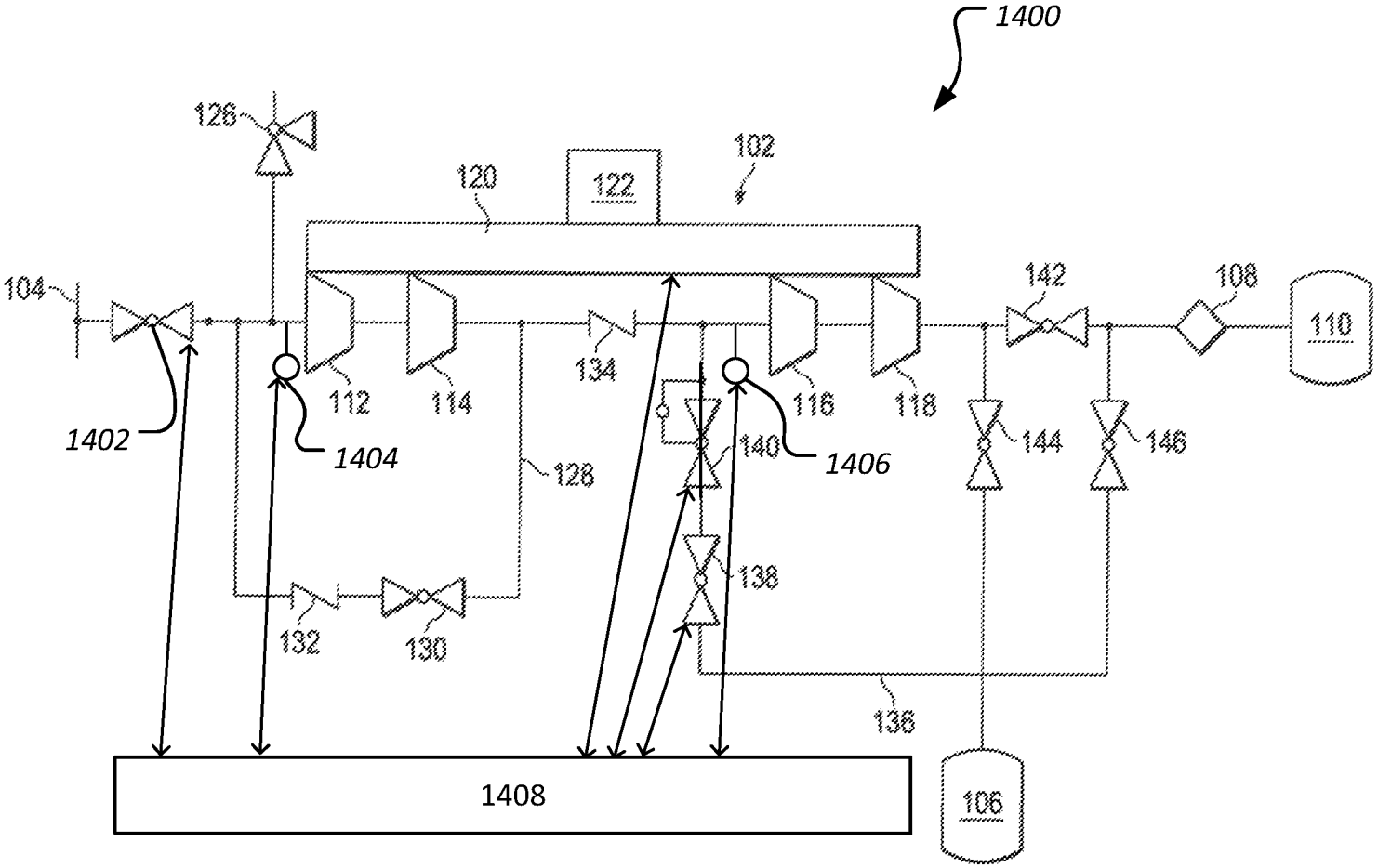
FIG. 14 is a schematic diagram of another CNG fueling system according to another embodiment of the disclosure.

Referring now to FIG. 14, a schematic diagram of a CNG fueling system 1400 according to another embodiment of the disclosure is shown. CNG fueling system 1400 is substantially similar to CNG fueling system 100. However, CNG fueling system 1400 comprises a suction block valve 1402 rather than regulator valve 124. The suction block valve 1402 is capable of selectively fully shutting off incoming gas from the source 104 from entering the compressor 102. CNG fueling system 1400 further additionally comprises pressure sensors 1404, 1406 configured to sense and report gas pressure. The pressure sensor 1404 is disposed and configured to selectively sense pressure upstream relative to the first compression stage 112 and downstream relative to the suction block valve 1402. The pressure sensor 1406 is configured to selectively sense and report pressure upstream relative to the third compression stage 116 and downstream relative to the second compression stage 114. Since this embodiment comprises only a single compressor 102, the pistons of all of the compression stages move during operation of the compressor 102 regardless of whether any of the compression stages are in a bypass or passthrough mode of operation.

In some embodiments, first and second compression stages 112, 114 can be disabled or otherwise converted to a bypass or passthrough mode of operation by opening valve 130 to allow gas to flow from the discharge of second compression stage 114 to the input of the first compression stage 112. With the valve 130 open, the pressure at the discharge of second compression stage 114 is caused to become substantially similar to the pressure at the input of the first compression stage 112. Movement of the gas from the discharge of second compression stage 114 to the input of the first compression stage 112 results in a pressure drop and is associated with wasted energy or horsepower. Accordingly, it is desirable to reduce the pressure associated with the stage bypass 128. The pressure of the stage bypass 128 can be reduced by reducing the amount of gas in the system.

The amount of gas in the system can be reduced by venting gas to the atmosphere, but this is typically undesirable. Accordingly, in some embodiments, gas in the system can be compressed by the compressor 102 and emitted from the fourth compression stage 118 and out of the compressor 102 while preventing additional gas from entering the compressor 102. To prevent entry of additional gas into the compressor 102, the block valve 1402 can be actuated to close off the supply of gas to the compressor 102.

Figure 15:
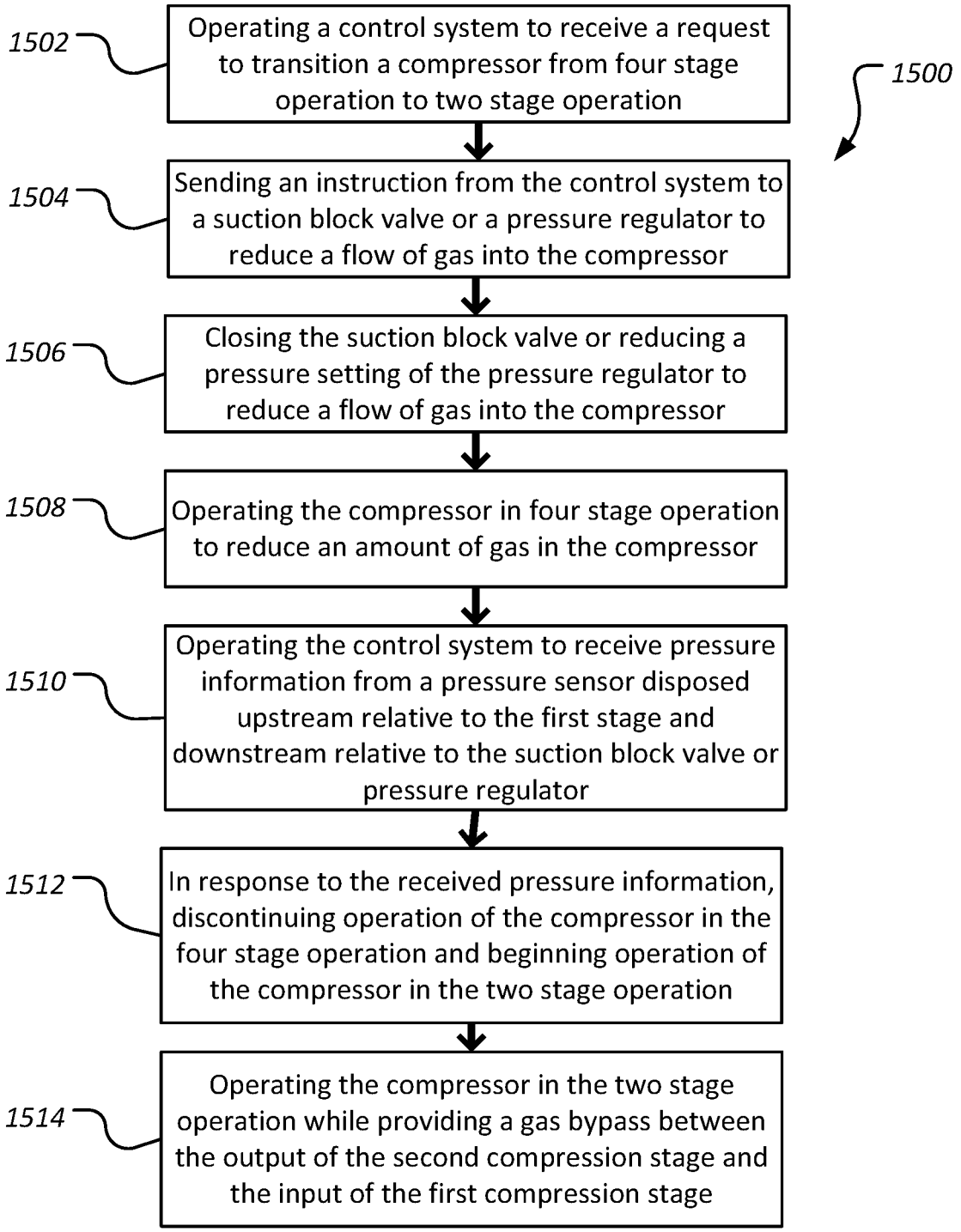
FIG. 15 is a flowchart of a method of operating a CNG fueling system.

Referring now to FIG. 15, a flowchart of a method 1500 of operating a CNG fueling system 1400 is shown. At block 1502, the operation can begin by a control system 1408 receiving a request to transition from four stage operation to two stage operation. Next at block 1504, the control system 1408 can instruct the suction block valve 1402 to close or position to substantially restrict gas flow therethrough. Next at block 1506, the suction block valve 1402 can be closed to prevent additional gas from entering the compressor 102. Next at block 1508, the compressor 102 can be operated in four stage operation while the suction block valve 1402 remains closed or substantially closed to discharge gas from the compressor 102 out of the fourth compression stage 118. At block 1510, the control system 1408 can monitor the pressure by receiving pressure information from the pressure sensor 1404. During this operation, the pressure reported by the pressure sensor 1404 will gradually reduce as the total amount of gas within the compressor 102 is reduced. At block 1512, the gas pressure sensed by the pressure sensor 1404 can be reduced to a predetermined threshold value associated with triggering switching the operation of the compressor 102 from four stage operation to two stage operation (where the first compression stage 112 and the second compression stage 114 are deactivated, unloaded, or otherwise configured to not provide significant amounts of compression).

At block 1514, the control system 1408 can control the compressor 102 to operate in the two stage mode by controlling the bypass valves 130 to open and cause a substantial equalization of the gas pressure across the first compression stage 112 and the second compression stage 114. By this methodology, the compressor 102 can be switched from four stage mode to two stage mode (operating the third compression stage 116 and the fourth compression stage 118 but not the first compression stage 112 and the second compression stage 114) in a manner that reduces the energy required to operate in two stage operation. At the time of converting from the four stage mode to the two stage mode, a reduced (or minimized) volume of gas remains in the compressor 102 that will allow the compressor 102 to operate in the four stage mode of operation. With the reduced amount of gas present in the first compression stage 112 and the second compression stage 114 and the stage bypass 128, a reduced (or minimized) amount of gas (lowest pressure) is associated with the first compression stage 112 and the second compression stage 114 during operation of the compressor 102 in the two stage mode of operation.

In another embodiment, the suction block valve 1402 could be replaced with a pressure regulator, such as regulator valve 124, so that when the control system 1408 receives the request to transition from four stage operation to two stage operation, a set point of the pressure regulator can be changed from to a greatly reduced suction pressure or a minimum suction pressure compatible with allowing the compressor 102 to continue operating. In some cases, the regulator valve 124 can be gradually transitioned from a higher suction pressure setting to a lower suction pressure setting (or minimum suction pressure setting) to allow a relatively more gradual transition.

In some embodiments, once the amount of the gas present in the compressor 102 is lowered or at a minimum amount which allows the compressor 102 to continue operating, it can be desirable to begin providing gas to the input of the third compression stage 116 from the storage tank 106. However, because the pressure of gas in the storage tank 106 can be as high as about 4000 psig and the pressure at the input of the third compression stage 116 may, in some embodiments, be as low as only on the order of hundreds of psig, suddenly opening the valve 138 can result in a shock or sudden change in pressure at the input of the third compression stage 116. Such drastic and sudden change in pressure at the input of the third compression stage 116 may cause damage to the compressor 102. Accordingly, in some cases, rather than only controlling flow of gas from the storage tank 106 with the valve 138, the pressure regulator 140 can be controlled to initially allow gas to flow from the storage tank 106 to the third compression stage 116 at a pressure substantially similar to the already existing initial lower pressure. In some cases, the initial lower pressure can be sensed by the pressure sensor 1404 and communicated to the control system 1408.

Figure 16:
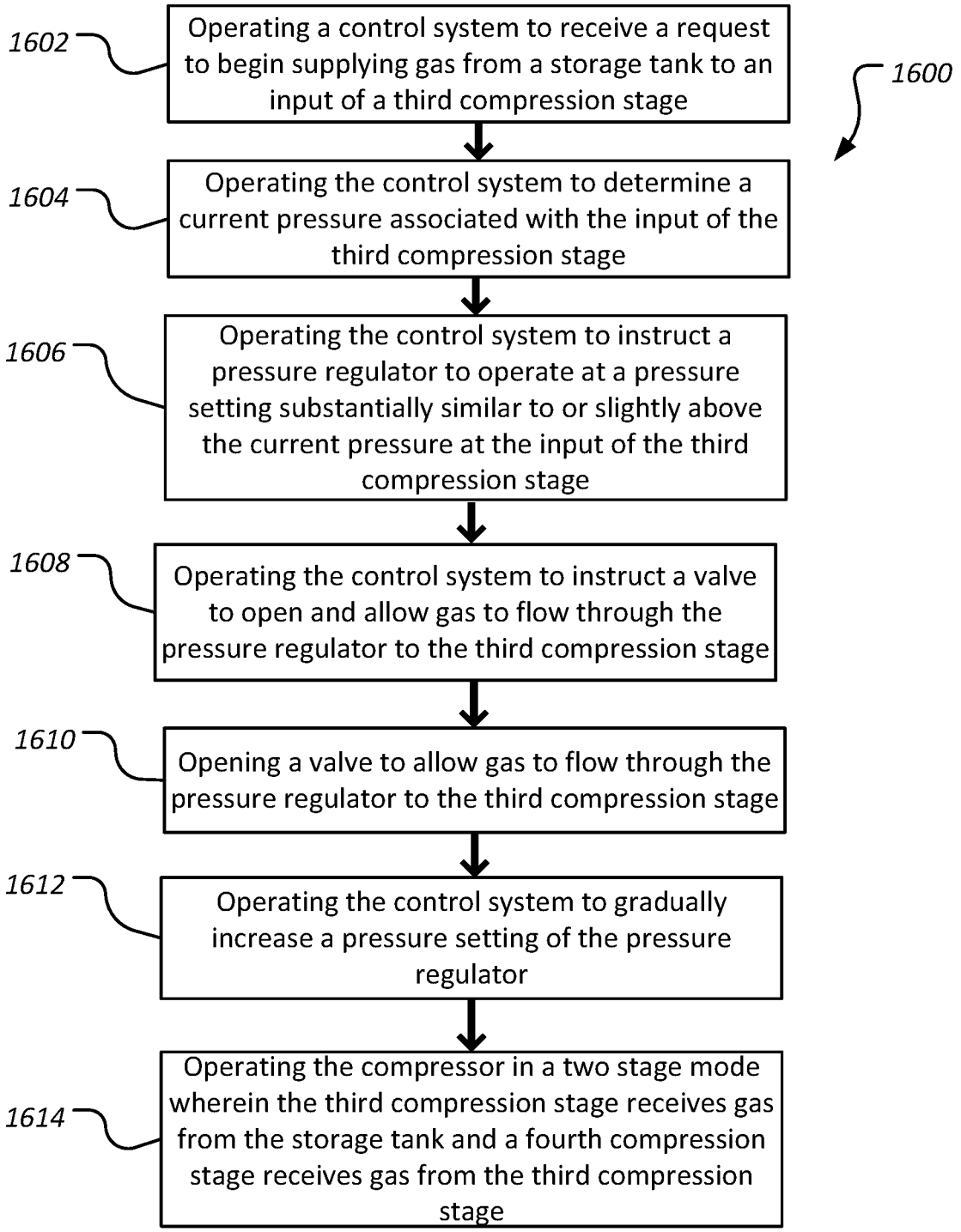
FIG. 16 is a flowchart of another method of operating a CNG fueling system.

Referring now to FIG. 16, a flowchart of a method 1600 of operating a CNG fueling system 1400 is shown. At block 1602, the method 1600 can begin by a control system 1408 receiving a request to begin supplying gas from the storage tank 106 to the input of the third compression stage 116. At block 1604, the control system 1408 can determine a current pressure at the input of the third compression stage 116 using information from the pressure sensor 1406. Next at block 1606, the control system 1408 can instruct the pressure regulator 140 to operate with a relatively low pressure setting that is substantially similar to or slightly higher than (higher but not high enough to present a concern of damaging the compressor 102) the pressure reported to the control system 1408 by the pressure sensor 1406. Next at block 1608, the control system 1408 can instruct the valve 140 to open. Next at block 1610, the valve 138 can be opened in response to the instruction from the control system 1408. With the valve 138 open, gas can begin flowing from the storage tank 106 to the input of the third compression stage 116 at the pressure setting of the pressure regulator 140. Next at block 1612, the control system 1408 can instruct the pressure regulator 140 to gradually increase the pressure setting of the pressure regulator 140 at a rate slow enough to prevent undesirable shock to the compressor 102. Next at block 1614, the compressor 102 can continue to operate in the two stage mode where only the third compression stage 116 and the fourth compression stage 118 are actively providing significant compression.

When it is desired to discontinue providing gas from the storage tank 106 to the compressor 102 and return the compressor 102 to normal four stage operation (as opposed to the near minimum required pressures achieved just prior to initiation of two stage operation described above), it can be advantageous to gradually decrease the pressure present at the input of the third compression stage 116 to an anticipated normal four stage operation pressure prior to resuming operation in normal four stage operation.

Figure 17:
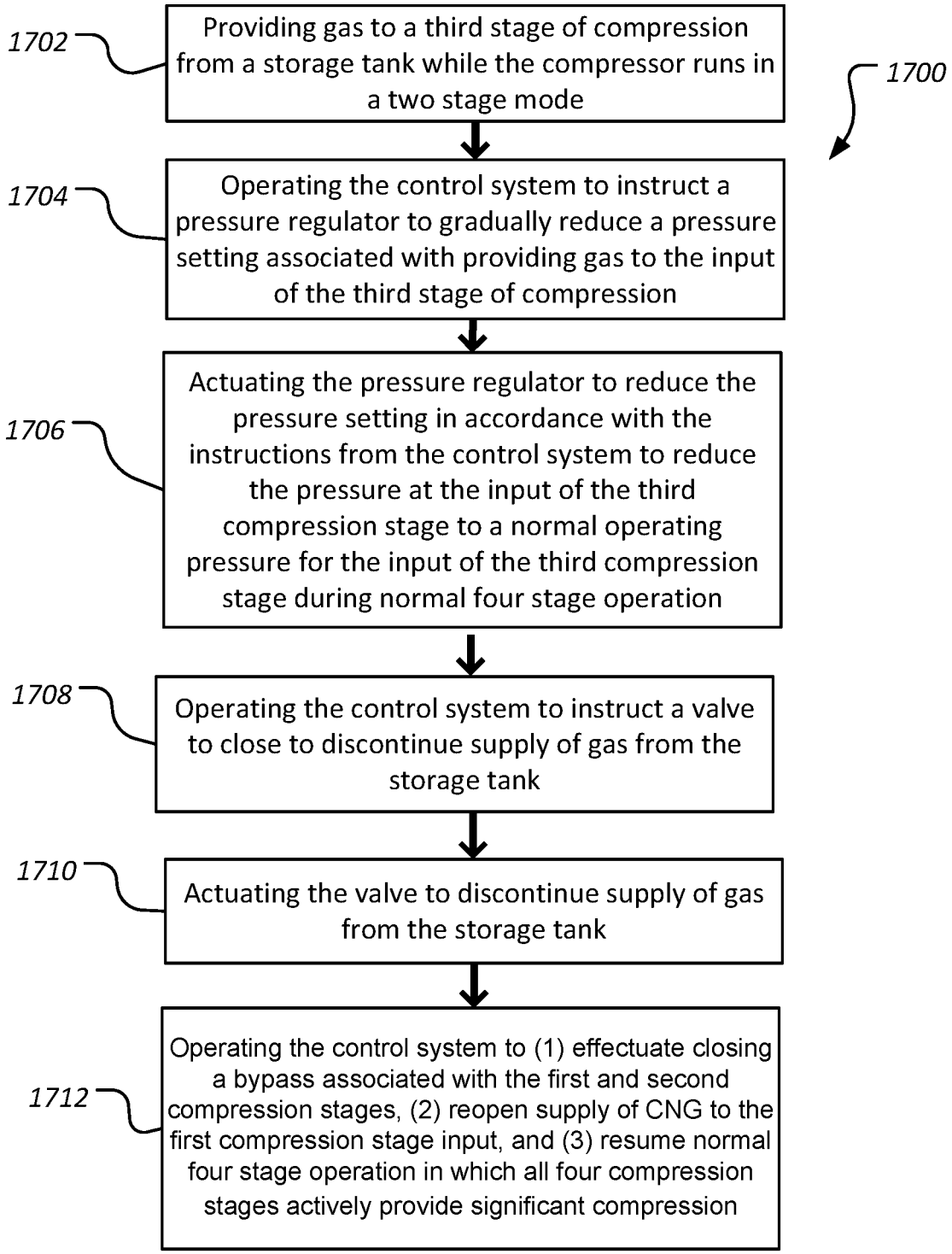
FIG. 17 is a flowchart of another method of operating a CNG fueling system.

Referring now to FIG. 17, a flowchart of a method 1700 of operating a CNG fueling system is shown. The method 1700 can begin at block 1702 by providing gas to the third compression stage 116 from the storage tank 106 while the compressor 102 is operating in the two stage mode. Next at block 1704, the control system 1408 can instruct the pressure regulator 140 to gradually decrease the pressure setting of the pressure regulator 140 (at a rate that avoids damage to the compressor 102). Next at block 1706, the pressure regulator 140 can reduce the pressure setting in accordance with the instructions, thereby decreasing the pressure at the input of the third compression stage 116 to a predetermined and/or known normal operation input pressure for the third compression stage 116 during normal four stage operation of the compressor 102. Next at block 1708, the control system 1408 can instruct the valve 138 to close. Next at block 1710, the valve 138 can be actuated to close off supply of the gas from the storage tank 106. With the valve 138 closed, the pressure at the inlet to the third compression stage 116 as reported by pressure sensor 1406 can be reduced to the normal expected pressure for the input to the third compression stage 116 when running in the four stage mode. Next at block 1712, the bypass 128 can be closed by closing valve 130 and the control system 1408 can instruct the compressor 102 to both open the valve 1402 and resume normal four stage operation in which all four compression stages 112, 114, 116, 118 are actively providing significant compression.

Figure 18:
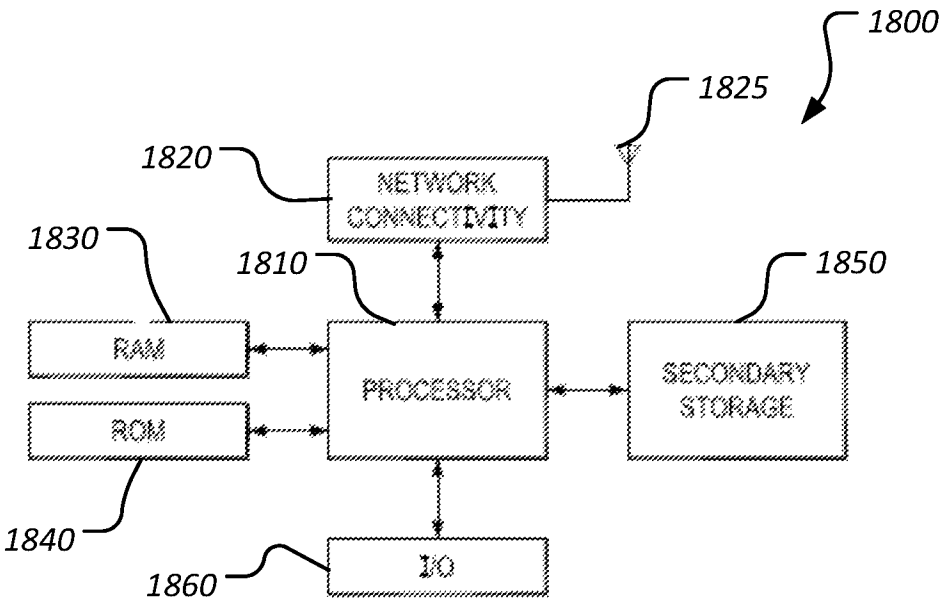
FIG. 18 is a schematic diagram of a general-purpose processor (e.g. electronic controller or computer) system suitable for implementing the embodiments of this disclosure.

Referring now to FIG. 18, a schematic diagram of a general-purpose processor (e.g. electronic controller or computer) system 1800 suitable for implementing the embodiments of this disclosure is shown. System 1800 includes a processing component 1810 suitable for implementing one or more embodiments disclosed herein. Particularly, the control system 1408 may comprise one or more systems 1800. In addition to the processor 1810 (which may be referred to as a central processor unit or CPU), the system 1800 might include network connectivity devices 1820, random access memory (RAM) 1830, read only memory (ROM) 1840, secondary storage 1850, and input/output (I/O) devices 1860. In some cases, some of these components may not be present or may be combined in various combinations with one another or with other components not shown. These components might be located in a single physical entity or in more than one physical entity. Any actions described herein as being taken by the processor 1810 might be taken by the processor 1810 alone or by the processor 1810 in conjunction with one or more components shown or not shown in the system 1800. It will be appreciated that the data described herein can be stored in memory and/or in one or more databases.

The processor 1810 executes instructions, codes, computer programs, or scripts that it might access from the network connectivity devices 1820, RAM 1830, ROM 1840, or secondary storage 1850 (which might include various disk-based systems such as hard disk, floppy disk, optical disk, or other drive). While only one processor 1810 is shown, multiple processors may be present. Thus, while instructions may be discussed as being executed by processor 1810, the instructions may be executed simultaneously, serially, or otherwise by one or multiple processors 1810. The processor 1810 may be implemented as one or more CPU chips and/or application specific integrated chips (ASICs).

The network connectivity devices 1820 may take the form of modems, modem banks, Ethernet devices, universal serial bus (USB) interface devices, serial interfaces, token ring devices, fiber distributed data interface (FDDI) devices, wireless local area network (WLAN) devices, radio transceiver devices such as code division multiple access (CDMA) devices, global system for mobile communications (GSM) radio transceiver devices, worldwide interoperability for microwave access (WiMAX) devices, and/or other well-known devices for connecting to networks. These network connectivity devices 1820 may enable the processor 1810 to communicate with the Internet or one or more telecommunications networks or other networks from which the processor 1810 might receive information or to which the processor 1810 might output information.

The network connectivity devices 1820 might also include one or more transceiver components 1825 capable of transmitting and/or receiving data wirelessly in the form of electromagnetic waves, such as radio frequency signals or microwave frequency signals. Alternatively, the data may propagate in or on the surface of electrical conductors, in coaxial cables, in waveguides, in optical media such as optical fiber, or in other media. The transceiver component 1825 might include separate receiving and transmitting units or a single transceiver. Information transmitted or received by the transceiver 1825 may include data that has been processed by the processor 1810 or instructions that are to be executed by processor 1810. Such information may be received from and outputted to a network in the form, for example, of a computer data baseband signal or signal embodied in a carrier wave. The data may be ordered according to different sequences as may be desirable for either processing or generating the data or transmitting or receiving the data. The baseband signal, the signal embedded in the carrier wave, or other types of signals currently used or hereafter developed may be referred to as the transmission medium and may be generated according to several methods well known to one skilled in the art.

The RAM 1830 might be used to store volatile data and perhaps to store instructions that are executed by the processor 1810. The ROM 1840 is a non-volatile memory device that typically has a smaller memory capacity than the memory capacity of the secondary storage 1850. ROM 1840 might be used to store instructions and perhaps data that are read during execution of the instructions. Access to both RAM 1830 and ROM 1840 is typically faster than to secondary storage 1850. The secondary storage 1850 is typically comprised of one or more disk drives or tape drives and might be used for non-volatile storage of data or as an over-flow data storage device if RAM 1830 is not large enough to hold all working data. Secondary storage 1850 may be used to store programs or instructions that are loaded into RAM 1830 when such programs are selected for execution or information is needed.

The I/O devices 1860 may include liquid crystal displays (LCDs), touchscreen displays, keyboards, keypads, switches, dials, mice, track balls, voice recognizers, card readers, paper tape readers, printers, video monitors, transducers, sensors, or other well-known input or output devices. Also, the transceiver 1825 might be considered to be a component of the I/O devices 1860 instead of or in addition to being a component of the network connectivity devices 1820. Some or all of the I/O devices 1860 may be substantially similar to various components disclosed herein and/or may be components of the above-described control system 1408.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, RI, and an upper limit, Ru, is disclosed, any number falling within the range is specifically disclosed. In particular, the following numbers within the range are specifically disclosed: R=RI+k*(Ru−RI), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A compressed natural gas (CNG) fueling system, comprising:

a single compressor comprising a first compression stage and a subsequent compression stage;

at least one of a pressure regulator and a valve disposed between a source of CNG and the first compression stage;

a pressure sensor disposed between the first compression stage and the subsequent compression stage; and a control system configured to selectively receive pressure information from the pressure sensor and configured to selectively control the at least one of the pressure regulator and the valve in association with at least one of converting between (1) operating both the first compression stage and the subsequent compression stage to operating only the subsequent compression stage and (2) operating only the subsequent compression stage to operating both the first compression stage and the subsequent compression stage.

2. The CNG fueling system of claim 1, wherein the control system is configured to cause closure of the valve or increased restriction of the pressure regulator and operation of both the first compression stage and the subsequent compression stage to reduce an amount of CNG in the compressor.

3. The CNG fueling system of claim 2, further comprising a CNG storage tank.

4. The CNG fueling system of claim 3, further comprising:

at least one of a pressure regulator and a valve disposed between the storage tank and an input of the subsequent compression stage.

* * * * *